US012084974B2

(12) United States Patent
McCormick et al.

(10) Patent No.: US 12,084,974 B2
(45) **Date of Patent: *Sep. 10, 2024**

(54) COMPRESSED AIR DRIVEN MOTOR

(71) Applicant: Graco Minnesota Inc., Minneapolis, MN (US)

(72) Inventors: Martin P. McCormick, Forest Lake, MN (US); Benjamin J. Dauwalter, Eden Prairie, MN (US); Kenneth C. Floer, Brooklyn Park, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 175 days.

This patent is subject to a terminal disclaimer.

(21) Appl. No.: 17/700,895

(22) Filed: Mar. 22, 2022

(65) Prior Publication Data

US 2022/0213789 A1 Jul. 7, 2022

Related U.S. Application Data

(63) Continuation of application No. 16/962,081, filed as application No. PCT/US2019/013173 on Jan. 11, 2019, now Pat. No. 11,306,590.

(Continued)

(51) Int. Cl.
*F01B 11/00* (2006.01)
*F01B 25/02* (2006.01)

(Continued)

(52) U.S. Cl.
CPC ..... *F01B 11/001* (2013.01); *F01B 31/005* (2013.01); *F01B 31/02* (2013.01); *F04B 9/125* (2013.01); *F01B 25/02* (2013.01)

(58) Field of Classification Search
CPC ..... F01B 11/001; F01B 25/02; F01B 31/005; F01B 31/02; F01L 25/063
See application file for complete search history.

(56) References Cited

U.S. PATENT DOCUMENTS 1,353,478 A 9/1920 Jeffries
1,601,136 A 9/1926 Percy
(Continued)

FOREIGN PATENT DOCUMENTS

CN 101495339 A 7/2009
JP H04503984 A 7/1992
(Continued)

OTHER PUBLICATIONS

1 Decision to Grant for JP Application No. 2020-538968, Dated Aug. 25, 2023, pp. 3.

(Continued)

*Primary Examiner* — Michael Leslie
(74) *Attorney, Agent, or Firm* — Kinney & Lange, P.A.

(57) ABSTRACT

An air motor assembly includes an exhaust block with an exhaust port that conveys exhaust air into an exhaust manifold. The exhaust port includes an expansion chamber that creates a pressure drop in the exhaust gas, thereby decreasing the temperature of the exhaust gas. The expansion chamber is defined between a first wall that is tangential to the air motor cylinder and a second wall that is transverse to an axis of the exhaust port. Poppet valves control actuation of a shuttle. The poppet valves are disposed on the exterior of the air motor assembly and are thermally insulated from the air motor assembly.

21 Claims, 16 Drawing Sheets

Related U.S. Application Data

(60) Provisional application No. 62/617,406, filed on Jan. 15, 2018.

(51) Int. Cl.

| | |
|---|---|
| ***F01B 31/00*** | (2006.01) |
| ***F01B 31/02*** | (2006.01) |
| ***F04B 9/125*** | (2006.01) |

(56) References Cited

U.S. PATENT DOCUMENTS

| | | | | |
|---|---|---|---|---|
| 1,713,047 | A | 5/1929 | Hamilton | |
| 2,405,317 | A | 8/1946 | Thelma | |
| 3,066,755 | A | 12/1962 | Carl | |
| 3,459,275 | A | 8/1969 | Prillwitz et al. | |
| 3,465,686 | A | 9/1969 | Nugier | |
| 3,618,468 | A * | 11/1971 | Gardner et al. | F01B 31/02 91/313 |
| 3,635,299 | A | 1/1972 | Hayes | |
| 3,675,732 | A | 7/1972 | Rosen et al. | |
| 3,745,886 | A | 7/1973 | Scheffer | |
| 3,943,823 | A | 3/1976 | Tammy | |
| 3,993,159 | A | 11/1976 | Amador | |
| 4,079,809 | A | 3/1978 | Visnapuu et al. | |
| 4,113,052 | A | 9/1978 | McElroy | |
| 4,227,591 | A | 10/1980 | Klaus et al. | |
| 4,789,131 | A * | 12/1988 | Vork | F01L 25/063 251/63.4 |
| 4,846,045 | A * | 7/1989 | Grach | F01L 25/063 91/308 |
| 4,921,408 | A | 5/1990 | Kvinge et al. | |
| 5,559,310 | A | 9/1996 | Hoover et al. | |
| 8,857,467 | B2 * | 10/2014 | Roman | F16K 3/246 137/625.6 |
| 9,156,050 | B2 * | 10/2015 | McCormick | F16K 11/207 |
| 9,162,866 | B2 * | 10/2015 | McCormick | F04B 23/06 |
| 9,540,971 | B2 * | 1/2017 | Bauck | F16N 13/16 |
| 11,306,590 | B2 * | 4/2022 | McCormick | F01B 11/001 |
| 2008/0253906 | A1 | 10/2008 | Strong | |
| 2009/0288403 | A1 | 11/2009 | Behrens et al. | |

FOREIGN PATENT DOCUMENTS

| | | | |
|---|---|---|---|
| JP | 2009544897 | A | 12/2009 |
| JP | 2010523897 | A | 7/2010 |
| KR | 20090033277 | A | 4/2009 |
| KR | 20090128466 | A | 12/2009 |
| KR | 20160051997 | A | 5/2016 |
| WO | 9504208 | A1 | 2/1995 |
| WO | 2008014322 | A2 | 1/2008 |
| WO | 2008124217 | A1 | 10/2008 |

OTHER PUBLICATIONS

Second Japanese Office Action for JP Applicaiton No. 2020-538968, Dated May 24, 2023, pp. 4.

First Chinese Office Action for CN Application No. 20190008375.3, Dated Aug. 2, 2021, pp. 16.

International Preliminary Report on Patentability for PCT Application No. PCT/US2019/013173, Dated Jul. 21, 2020, pp. 11.

International Search Report and Written Opinion for PCT Application No. PCT/US2019/013173, Dated Jun. 26, 2019, pp. 18.

Korean Preliminary Rejection for KR Application No. 10-2020-7022815, Dated Nov. 24, 2021, pp. 11

First Chinese Office Action for CN Application No. 202210995683.3, Dated Jun. 29, 2023, pp. 28.

Second Korean Office Action for KR Application No. 10-2022-7032615, Dated Jul. 17, 2023, pp. 5.

Extended European Search Report for EP Application No. 22152976.1, Dated Mar. 21, 2022, pp. 8.

First Japanese Office Action for JP Applicaiton No. 2020-538968, Dated Dec. 9, 2022, pp. 8.

First Korean Office Action for KR Application No. 10-2022-7032615, Dated Dec. 15, 2022, pp. 11.

* cited by examiner

COMPRESSED AIR DRIVEN MOTOR

CROSS-REFERENCE TO RELATED APPLICATION

This application is a continuation of U.S. application Ser. No. 16/962,081 filed Jul. 14, 2020 and entitled "COMPRESSED AIR DRIVEN MOTOR," which in turn is a national stage filing of International PCT Application No. PCT/US2019/13173 filed Jan. 11, 2019 for "COMPRESSED AIR DRIVEN MOTOR," which in turn claims the benefit of U. S. Provisional Application No. 62/617,406 filed Jan. 15, 2018, and entitled "COMPRESSED AIR DRIVEN MOTOR," the disclosures of which are hereby incorporated by reference in their entireties.

BACKGROUND

This disclosure relates generally to air motors. More specifically, this disclosure relates to control and poppet valves for an air driven motor.

Pneumatic motors are driven by the expansion of compressed air, typically by either a linear motion or a rotary motion. With linear motion, the compressed air drives a diaphragm or piston actuator disposed within the air motor. The compressed air is directed to both sides of the actuator to create an upstroke and a downstroke. The change of air flow to the piston is controlled by an air motor control valve and, in most examples, two poppet valves. Air motors can be used to drive various components. For example, an air motor can be used to drive one or more pumps, such as pumps for a spraying system.

Air motors are prone to icing, especially near the exhaust and the poppet valves. Further, icing is prone to form on the cylinder sleeve and adjacent cylinder housing of the air motor as those components cool. Icing is a result of the Venturi effect. Ice will form adjacent to a pressure drop (in accordance with the Venturi effect and the Ideal Gas Law), such as near the compressed air leaving a poppet valve or the air motor exhaust. When compressed air driven motors release a large amount of compressed air, the pressure and temperature of the air drops suddenly with a spike in velocity and drop in pressure as the compressed air expands. This sudden temperature drop causes water vapor in the air to change from gas to liquid, and quickly freeze on anything the water vapor contacts. Because of the large temperature drop, icing in an air motor frequently occurs at ambient environmental temperatures well above freezing. The housing of the air motor will eventually cool after extended operation as a result of the cooled air flowing within and/or near the housing, leading to ice accumulation where the cooled air contacts the housing and/or the other air motor components. Ice accumulation in the air motor is most predominate when the exhausted air immediately contacts a part of the air motor, such as the air motor housing or the exit side of a poppet valve. The icing can clog the exhaust of the air motor, causing the air motor to seize.

Further, the poppet valves in an air motor are embedded in the body of the housing of the air motor. The poppet valves are not exposed to the ambient environmental temperature and have substantial cooling due to conduction between the poppet valves and the adjacent air motor housing. The substantial cooling causes icing on the poppet valve and immediately downstream of the poppet valve. This icing can cause the air motor to seize as the poppet valves are no longer able to actuate the air motor control valve due to ice accumulation. Because the poppet valve is embedded in the body of the housing of the air motor, the poppet valve may not be removable from the air motor without disassembling at least a portion of the air motor.

SUMMARY

According to an aspect of the disclosure, an air motor assembly includes an air motor cylinder, an exhaust manifold extending at least partially around the air motor cylinder, and a control valve configured to provide motive fluid to the air motor cylinder and to receive exhaust fluid from the air motor cylinder. The exhaust manifold has an exhaust inlet, an exhaust outlet, and an exhaust passage extending between the exhaust inlet and the exhaust outlet. The control valve includes an exhaust port in fluid communication with the exhaust passage. The exhaust port is disposed on a port axis and includes an expansion chamber extending into the exhaust inlet of the exhaust manifold.

According to another aspect of the disclosure, a sprayer includes a pump, and an air motor assembly operatively connected to the pump. The air motor assembly includes an air motor cylinder, a reciprocating piston disposed within the air motor cylinder, a connecting rod extending between and connected to the reciprocating piston and the pump, an exhaust manifold extending at least partially around the air motor cylinder, and a control valve configured to provide motive fluid to the air motor cylinder and to receive exhaust fluid from the air motor cylinder. The exhaust manifold has an exhaust inlet, an exhaust outlet, and an exhaust passage extending between the exhaust inlet and the exhaust outlet. The control valve includes an exhaust port in fluid communication with the exhaust passage. The exhaust port is disposed on a port axis and includes an expansion chamber extending into the exhaust inlet of the exhaust manifold.

According to a further aspect of the disclosure, a method includes directing driving air (e.g., motive fluid) from an air inlet to a first port, with a shuttle, the first port fluidly connected to an air motor cylinder; directing exhaust air (e.g., exhaust fluid) from a second port to an exhaust port, with the shuttle, the second port fluidly connected to the air motor cylinder; flowing the exhaust air through the exhaust port prior to the exhaust air entering an exhaust manifold, wherein the exhaust port receives the exhaust air from the shuttle through a port inlet and ejects the exhaust air to the exhaust manifold through an expansion chamber. The exhaust port includes a first wall extending from the port inlet, which has a first width, to an outlet having a second width greater than the first width, wherein the first wall is disposed substantially parallel to a port axis of the exhaust port; a second wall opposing the first wall, the second wall extending from the inlet to an upstream end of the expansion chamber, the second wall disposed substantially parallel to the port axis; and a third wall extending from the second wall to the outlet, the third wall disposed transverse to the port axis. The expansion chamber is defined between the first wall and the third wall.

According to a further aspect of the disclosure, an air motor assembly includes an air motor cylinder, a control valve, a first poppet valve, a first poppet line, a second poppet valve, and a second poppet line. The air motor cylinder includes an upper cylinder housing having an upper port, a lower cylinder housing having a lower port, a motor cylinder disposed between the upper cylinder housing and the lower cylinder housing, and a piston disposed within the motor cylinder and configured to reciprocate within the motor cylinder between the upper cylinder housing and the lower cylinder housing. The control valve is configured to direct air to the upper port and the lower port in an alternating manner to drive reciprocation of the piston. The first poppet valve is disposed on an exterior of the upper cylinder housing. The first poppet line extends from the first poppet valve to the control valve. The second poppet valve is disposed on an exterior of the lower cylinder housing. The second poppet line extends from the second poppet valve to the control valve. The first poppet valve and the second poppet valve are configured to control actuation of a shuttle of the control valve. The first poppet line and the second poppet line are disposed external to the air motor cylinder.

DETAILED DESCRIPTION

Figure 1:
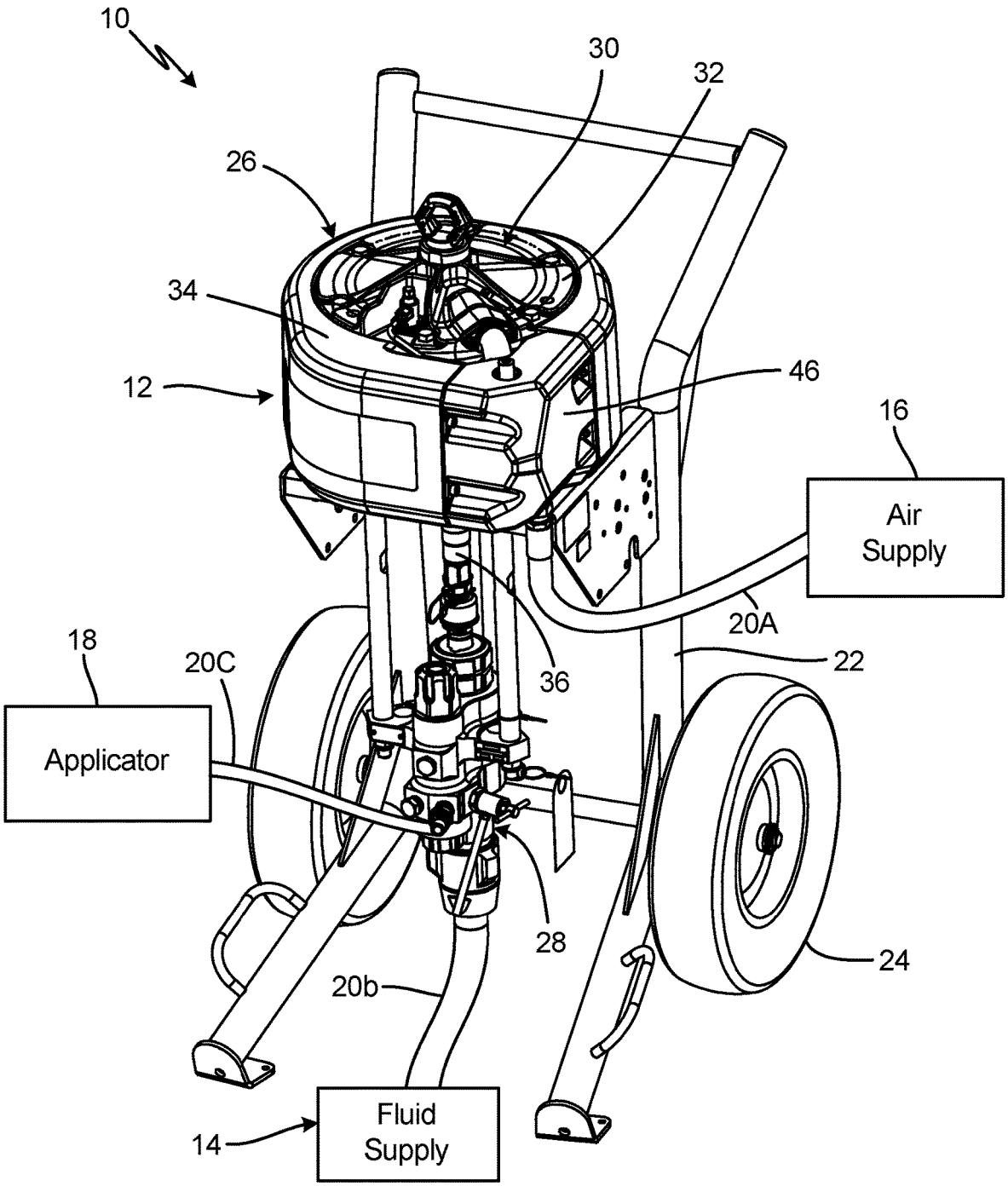
FIG. 1 is an isometric view of a sprayer system.

FIG. 1 is an isometric view of sprayer system 10. Sprayer system 10 includes sprayer 12, fluid supply 14, air supply 16, applicator 18, and hoses 20*a*-20*c*. Sprayer 12 includes frame 22, wheels 24, air motor assembly 26, and pump 28. Air motor 30 of air motor assembly 26 includes motor cylinder 32, exhaust manifold 34, and connecting rod 36.

Air motor assembly 26 is disposed on and supported by frame 22. Pump 28 is also connected to and supported by frame 22. Wheels 24 are mounted to frame 22. Motor cylinder 32 encloses reciprocating components of air motor 30. Connecting rod 36 is attached to and driven by the reciprocating components. Connecting rod 36 extends from motor cylinder 32 and is attached to pump 28. Connecting rod 36 is configured to drive reciprocation of a pumping component of pump 28, such as a piston or diaphragm.

Exhaust manifold 34 extends around motor cylinder 32. A control valve, such as control valve 38 (best seen in FIG. 3A), is mounted to motor cylinder 32 and configured to direct compressed air from air supply 16 to motor cylinder 32, and to direct exhaust gas from motor cylinder 32 to exhaust manifold 34. Valve cover 46 encloses the control valve. Exhaust gas is compressed air that has already driven the reciprocating components through an upstroke or a downstroke. As such, the compressed air provided by air supply 16 becomes exhaust gas when the reciprocating components reverse stroke direction.

Air supply 16 is connected to the control valve by hose 20*a*. Air supply 16 is configured to compress air and provide the compressed air to air motor assembly 26 to power air motor 30. Fluid supply 14 stores a supply of fluid for spraying. Fluid supply 14 is connected to pump 28 by hose 20*b*. Hose 20*c* extends from pump 28 to applicator 18. Pump 28 is configured to draw fluid from fluid supply through hose 20*b* and pump the fluid to applicator 18 through hose 20*c*. Applicator 18 applies the pumped fluid to a desired surface.

During operation, the control valve directs the compressed air from air supply 16 to opposing sides of the reciprocating components in motor cylinder 32 to drive reciprocation of those components. The compressed air directed to air supply 16 is motive fluid that drives reciprocation of the components in motor cylinder 32. The control valve also receives exhaust gas (e.g., exhaust fluid) from motor cylinder 32 and directs the exhaust gas to exhaust manifold 34. Exhaust manifold 34 ejects the exhaust gas to the atmosphere.

Figure 2A:
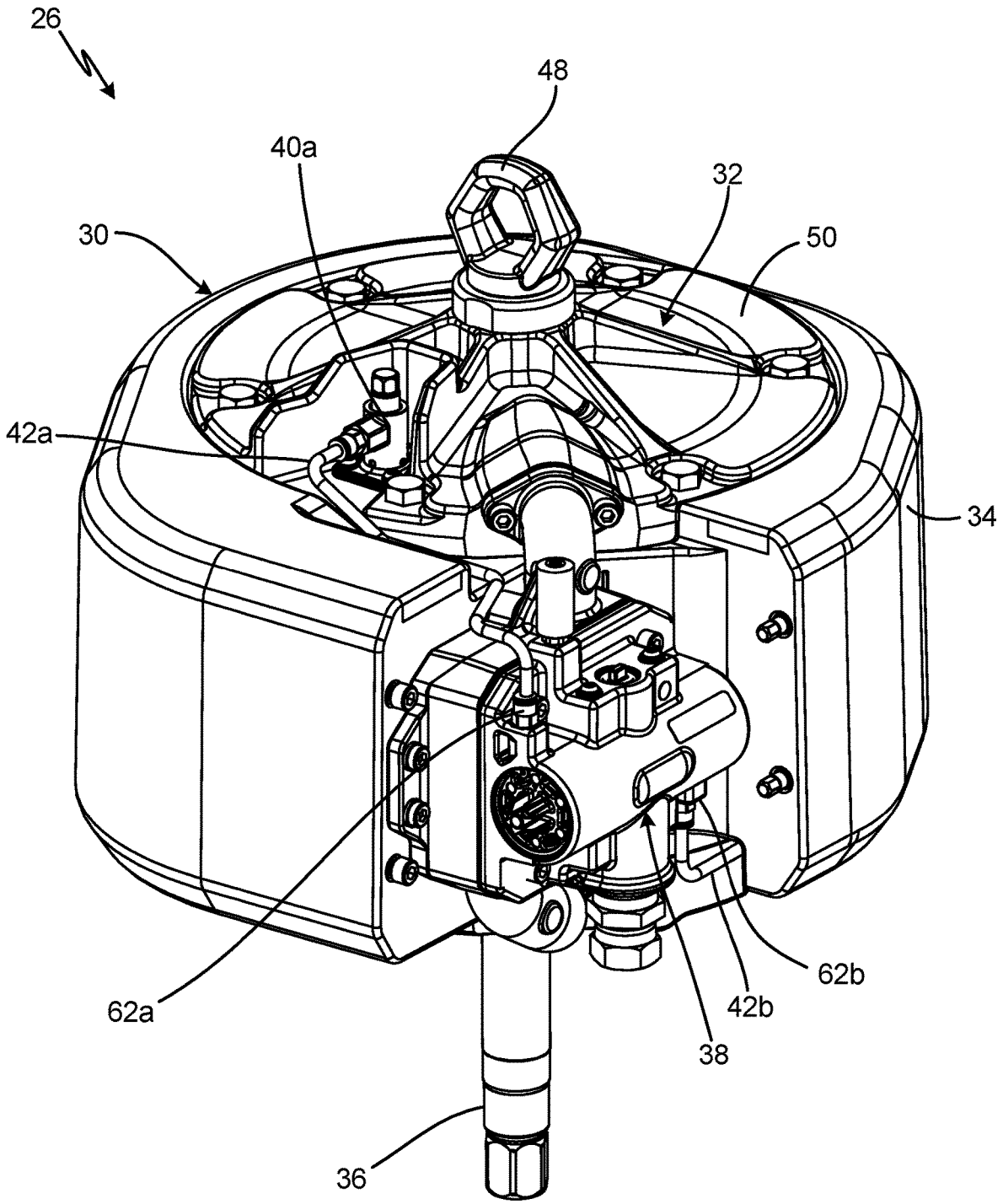
FIG. 2A is an isometric view of an air motor assembly with a valve cover removed.
Figure 2B:
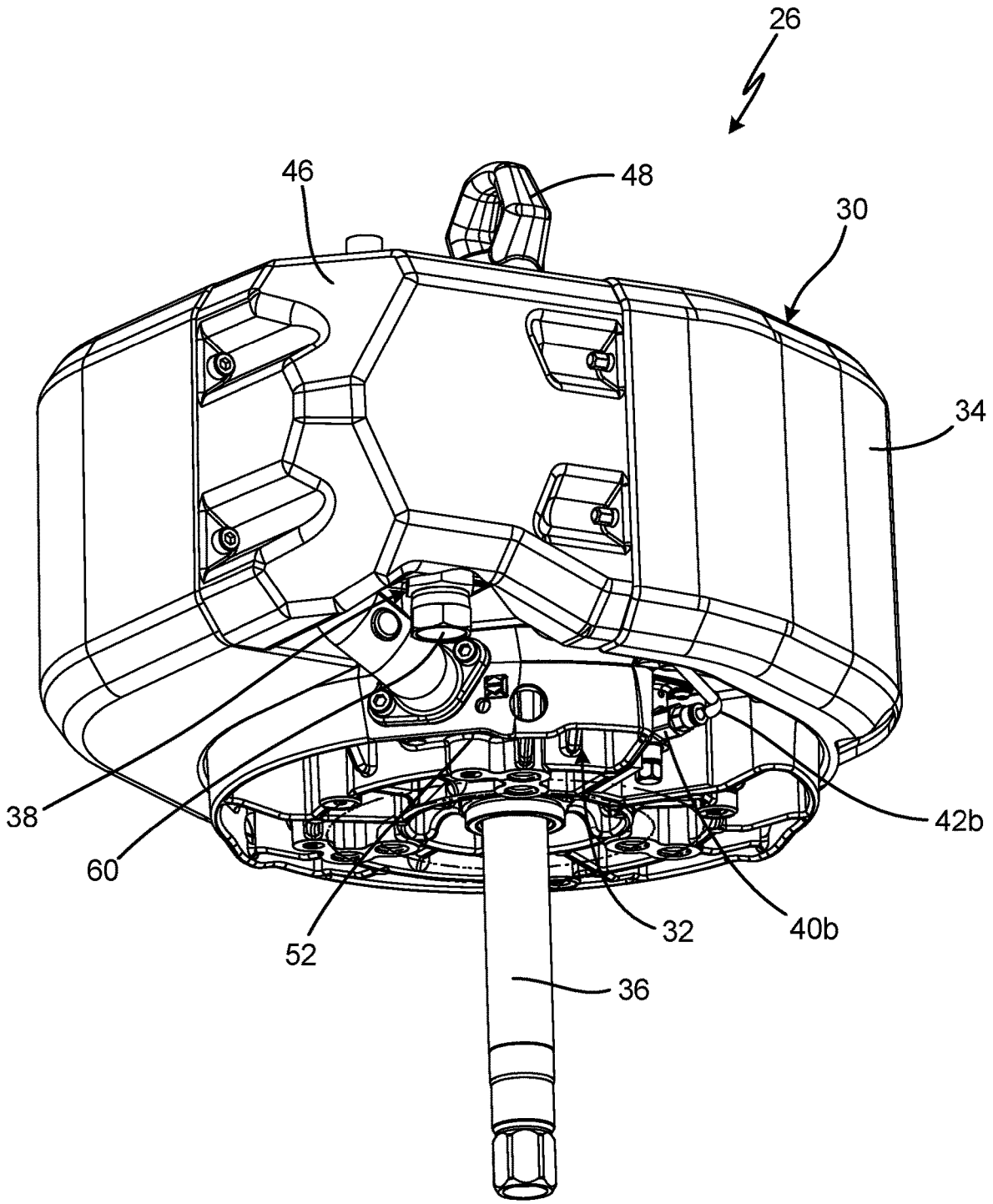
FIG. 2B is another isometric view of an air motor assembly.
Figure 2C:
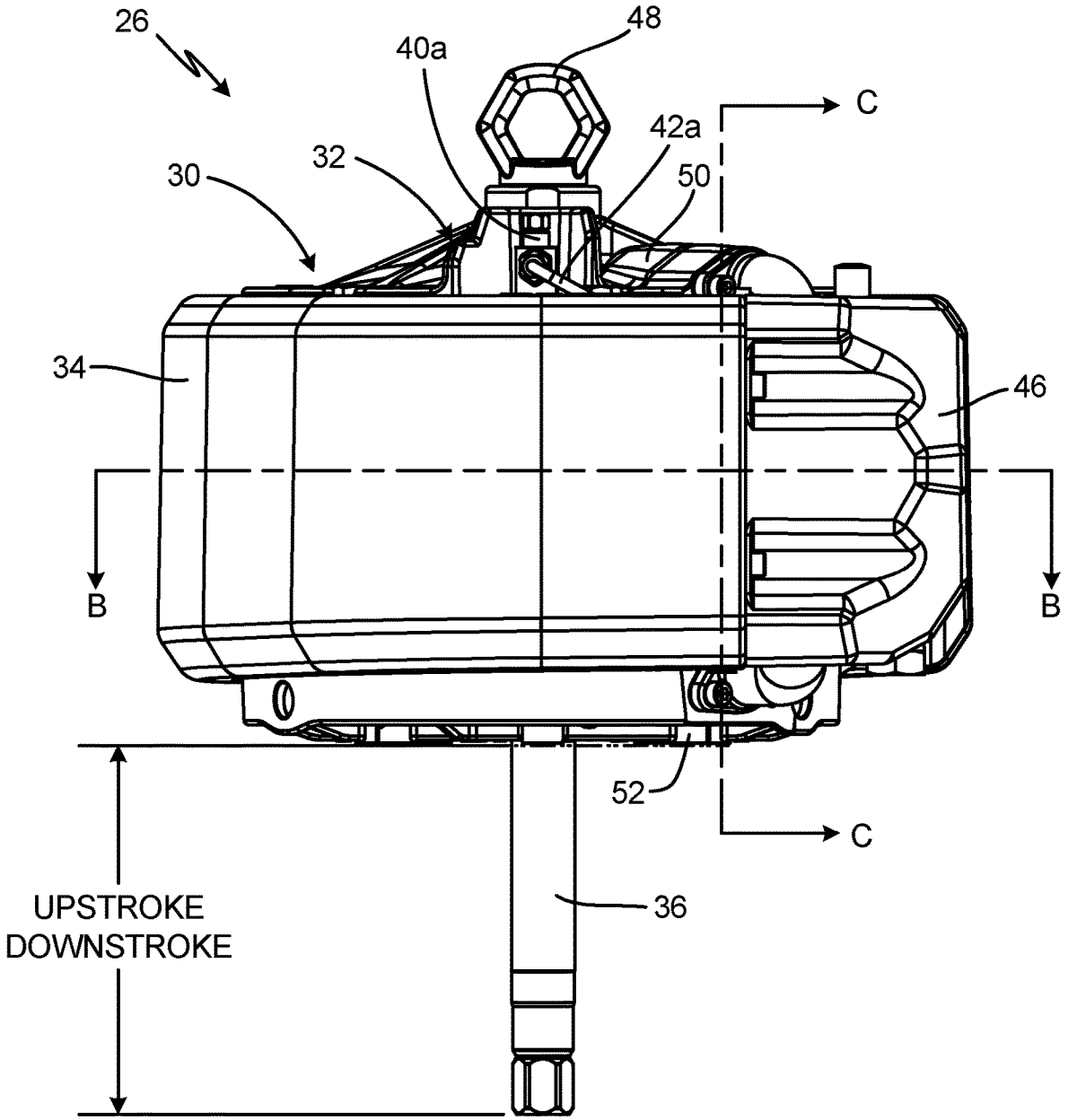
FIG. 2C is a side elevation view of an air motor assembly.
Figure 2D:
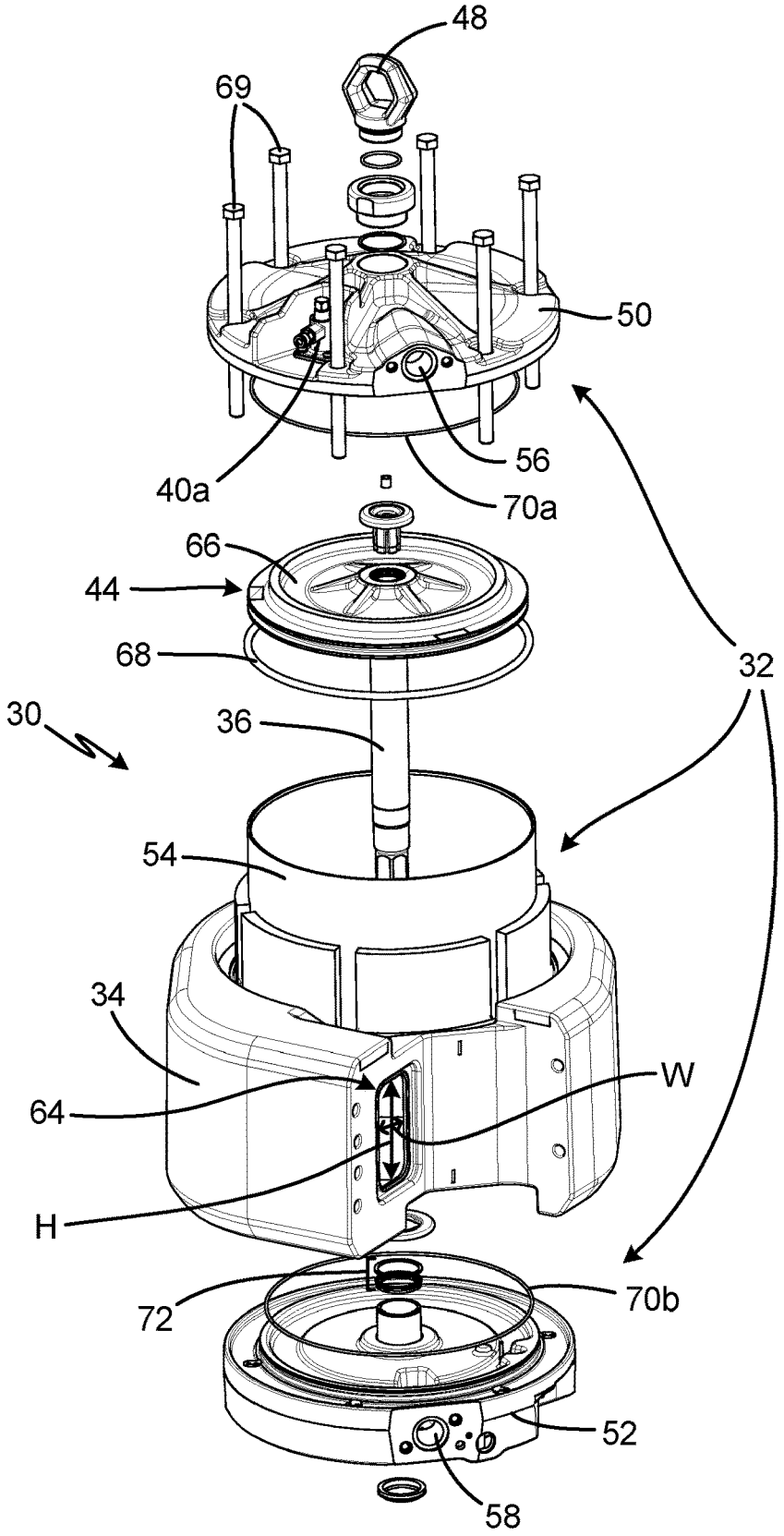
FIG. 2D is an exploded view of an air motor.

FIG. 2A is an isometric view of air motor assembly 26 with valve cover 46 removed so that control valve 38 can be seen. FIG. 2B is another isometric view of air motor assembly 26. FIG. 2C is a side elevation view of air motor assembly 26. FIG. 2D is an exploded view of air motor 30. FIGS. 2A-2D will be discussed together. Air motor assembly 26 includes air motor 30, control valve 38 (best seen in FIG. 2A), poppet valves 40*a*-40*b*, and poppet lines 42*a*-42*b*. Air motor 30 includes motor cylinder 32, exhaust manifold 34, connecting rod 36, piston 44 (FIG. 2D), valve cover 46 (FIGS. 2B-2C), and loop 48. Motor cylinder 32 includes upper cylinder housing 50 (FIGS. 2A, 2C, and 2D), lower cylinder housing 52 (FIGS. 2B, 2C, and 2D), and cylinder sleeve 54 (FIG. 2D). Upper cylinder housing 50 includes upper port 56 (FIG. 2D), and lower cylinder housing 52 includes lower port 58 (FIG. 2D). Control valve 38 includes air inlet 60 and poppet ports 62*a*-62*b*. Exhaust manifold 34 includes exhaust inlet 64 (FIG. 2D). Piston 44 includes piston plate 66 and seal 68.

As best seen in FIG. 2D, fasteners 69 extend through upper cylinder housing 50 into lower cylinder housing 52. Cylinder sleeve 54 is clamped between upper cylinder housing 50 and lower cylinder housing 52. Seal 70*a* is disposed between cylinder sleeve 54 and upper cylinder housing 50 to prevent air from leaking between cylinder sleeve 54 and upper cylinder housing 50. Seal 70*b* is disposed between cylinder sleeve 54 and lower cylinder housing 52 to prevent air from leaking between cylinder sleeve 54 and lower cylinder housing 52. Loop 48 is attached to upper cylinder housing 50 to facilitate lifting of air motor 30.

Piston 44 is disposed within cylinder sleeve 54 and is configured to reciprocate through an upstroke and a downstroke, as indicated in FIG. 2C, to drive reciprocation of connecting rod 36. Seal 68 extends around piston plate 66 and prevents the compressed air from flowing past piston plate 66. Connecting rod 36 extends from piston plate 66 through lower cylinder housing 52. Seals 72 extend around connecting rod 36 to prevent air from leaking between connecting rod 36 and lower cylinder housing 52. Connecting rod 36 is connected to pump 28 (FIG. 1) and configured to drive pump 28. While air motor 30 is shown as including piston 44, it is understood that air motor 30 can include any suitable actuator for driving reciprocation of connecting rod 36, such as a flexible diaphragm disposed in cylinder sleeve 54 with connecting rod 36 extending from the flexible diaphragm.

Upper port 56 extends into upper cylinder housing 50 and is fluidly connected to an interior area of cylinder sleeve 54 disposed between piston 44 and upper cylinder housing 50. Lower port 58 extends into lower cylinder housing 52 and is fluidly connected to an interior area of cylinder sleeve 54 disposed between piston plate 66 and lower cylinder housing 52. Control valve 38 is mounted to exhaust manifold 34 and is configured to direct air to and receive exhaust gas from upper port 56 and lower port 58. Valve cover 46 is mounted on exhaust manifold 34 and encloses control valve 38 during operation.

Control valve 38 receives compressed air from air supply 16 (FIG. 1) through air inlet 60. Exhaust manifold 34 extends around cylinder sleeve 54 and provides a pathway for exhaust gases to exit air motor 30. Control valve 38 ejects exhaust gas into exhaust manifold 34 through exhaust inlet 64. Exhaust inlet 64 is oriented vertically, such that height H of exhaust inlet 64 is larger than width W of exhaust inlet 64. Orienting exhaust inlet 64 vertically spaces exhaust inlet 64 from cylinder sleeve 54 and discourages the exhaust gas from expanding towards cylinder sleeve 54 when the exhaust gas enters exhaust inlet 64.

Poppet valve 40*a* is disposed on upper cylinder housing 50. Poppet line 42*a* extends from poppet valve 40*a* to poppet port 62*a* on control valve 38. Poppet valve 40*b* is disposed on lower cylinder housing 52. Poppet line 42*b* extends from poppet valve 40*b* to poppet port 62*b* on control valve 38.

Control valve 38 directs compressed air from air source to upper port 56 and lower port 58 in an alternating manner to cause piston 44 to proceed through the upstroke and the downstroke. The compressed air that causes reciprocation of piston 44 can be referred to as motive fluid, driving fluid, driving air, and/or motive air. The shuttle within control valve 38 directs the compressed air from air supply 16 to either upper port 56, to drive connecting rod 36 through a downstroke, or to lower port 58, to drive connecting rod 36 through an upstroke. The shuttle directs exhaust gas from the other of upper port 56 and lower port 58 to exhaust manifold 34.

Poppet lines 42*a*, 42*b* are pressurized by the compressed air flowing through control valve 38. Poppet valves 40*a*, 40*b* control pressurization of poppet lines 42*a*, 42*b* to control movement of a shuttle disposed within control valve 38. The pressure within poppet lines 42*a*, 42*b* is balanced with both poppet valves 40*a*, 40*b* closed, such that the shuttle is stationary. Piston 44 is configured to contact and open one of poppet valve 40*a*, 40*b* when piston 44 reaches the end of a stroke. Opening one of poppet valve 40*a*, 40*b* allows the air in poppet line 42*a*, 42*b* to vent through poppet valve 40*a*, 40*b*, reducing the pressure on one side of the shuttle. The pressure in the other poppet line 42*a*, 42*b* actuates the shuttle, and the shuttle redirects the air flowing to control valve 38 and causes piston 44 to reverse stroke direction.

During a downstroke, control valve 38 directs the compressed air to upper port 56. Upper port 56 provides the compressed air to cylinder sleeve 54, and the compressed air drives piston 44 downward, causing connecting rod 36 to proceed through the downstroke. The downward movement of piston 44 drives the air disposed in cylinder sleeve 54 between piston 44 and lower cylinder housing 52 out of cylinder sleeve 54 through lower port 58. This air is exhaust gas. The exhaust gas flows from lower port 58 to control valve 38, and the shuttle of control valve 38 directs the exhaust air to exhaust manifold 34. When piston 44 reaches the end of the downstroke, piston plate 66 impacts a rod of poppet valve 40*b*, causing poppet valve 40*b* to open and vent the pressurized air in poppet line 42*b* to the atmosphere. The pressure in poppet line 42*b* becomes lower than the pressure in poppet line 42*a*, such that the pressurized air in poppet line 42*a* causes the shuttle of control valve 38 to shift positions. In the new position, the shuttle directs the compressed air from air supply 16 to lower port 58 and receives exhaust gas from upper port 56.

During an upstroke, control valve 38 directs the compressed air to lower port 58. Lower port 58 provides the compressed air to cylinder sleeve 54, and the compressed air drives piston 44 into the upstroke. As piston 44 begins the upstroke, poppet valve 40*b* closes, and the compressed air flowing through control valve 38 repressurizes poppet line 42*b*. The upward movement of piston 44 drives the air previously provided to cylinder sleeve 54 through upper port 56 out of upper port 56 as exhaust gas. The exhaust gas flows from upper port 56 to control valve 38, and control valve 38 directs the exhaust air to exhaust manifold 34 through exhaust inlet 64. When piston 44 reaches the end of the upstroke, piston plate 66 impacts a rod of poppet valve 40*a*, causing poppet valve 40*a* to open and vent the pressurized air in poppet line 42*a*. The pressure in poppet line 42*a* is thus lower than the pressure in poppet line 42*b*, such that the pressurized air in poppet line 42*b* causes the shuttle of control valve 38 to shift positions. The shuttle directs the compressed air from air supply 16 to upper port 56 and receives exhaust gas from lower port 58. The compressed air drives piston 44 through another downstroke.

Figure 3A:
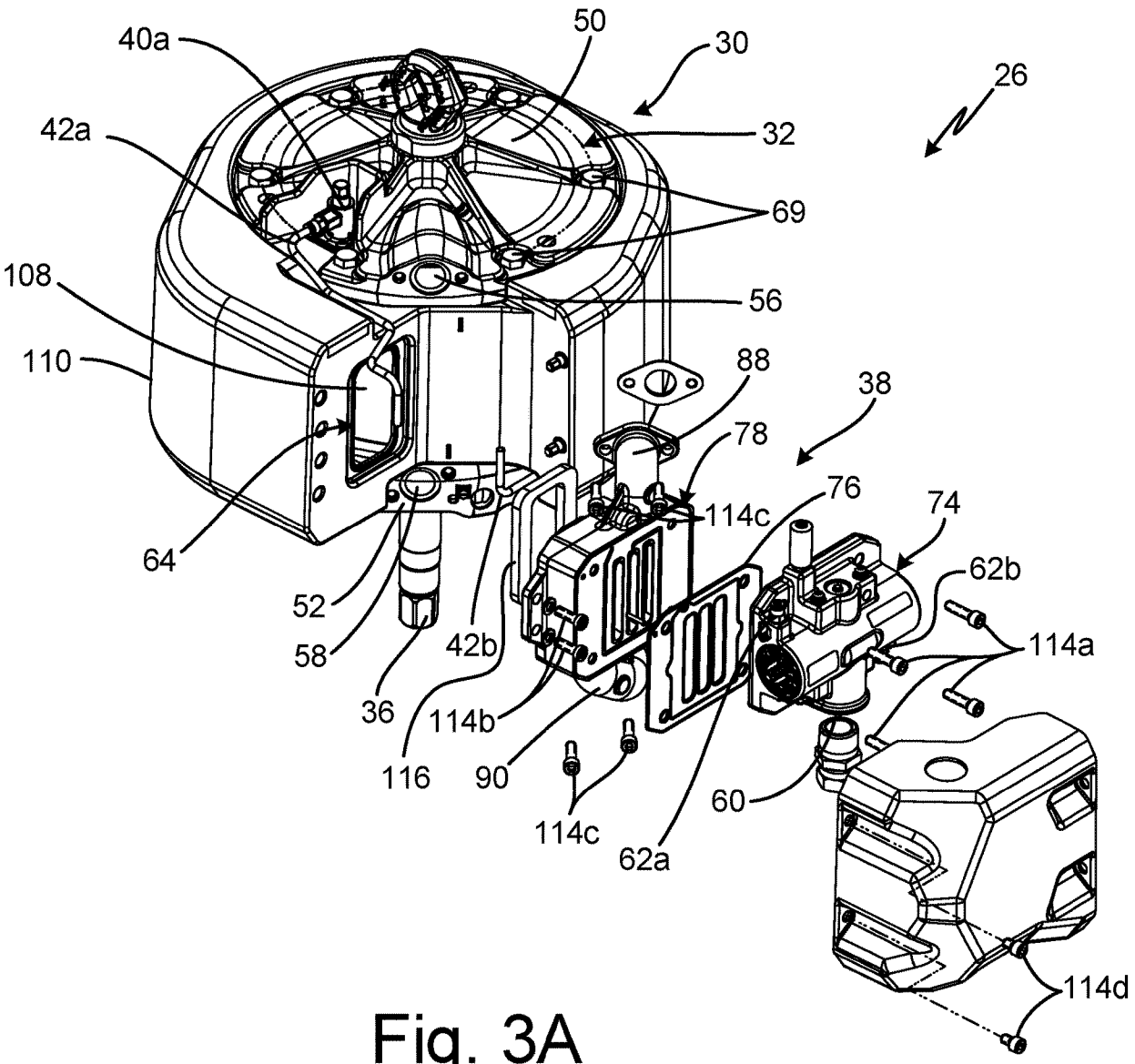
FIG. 3A is a partially exploded view of an air motor assembly.
Figure 3B:
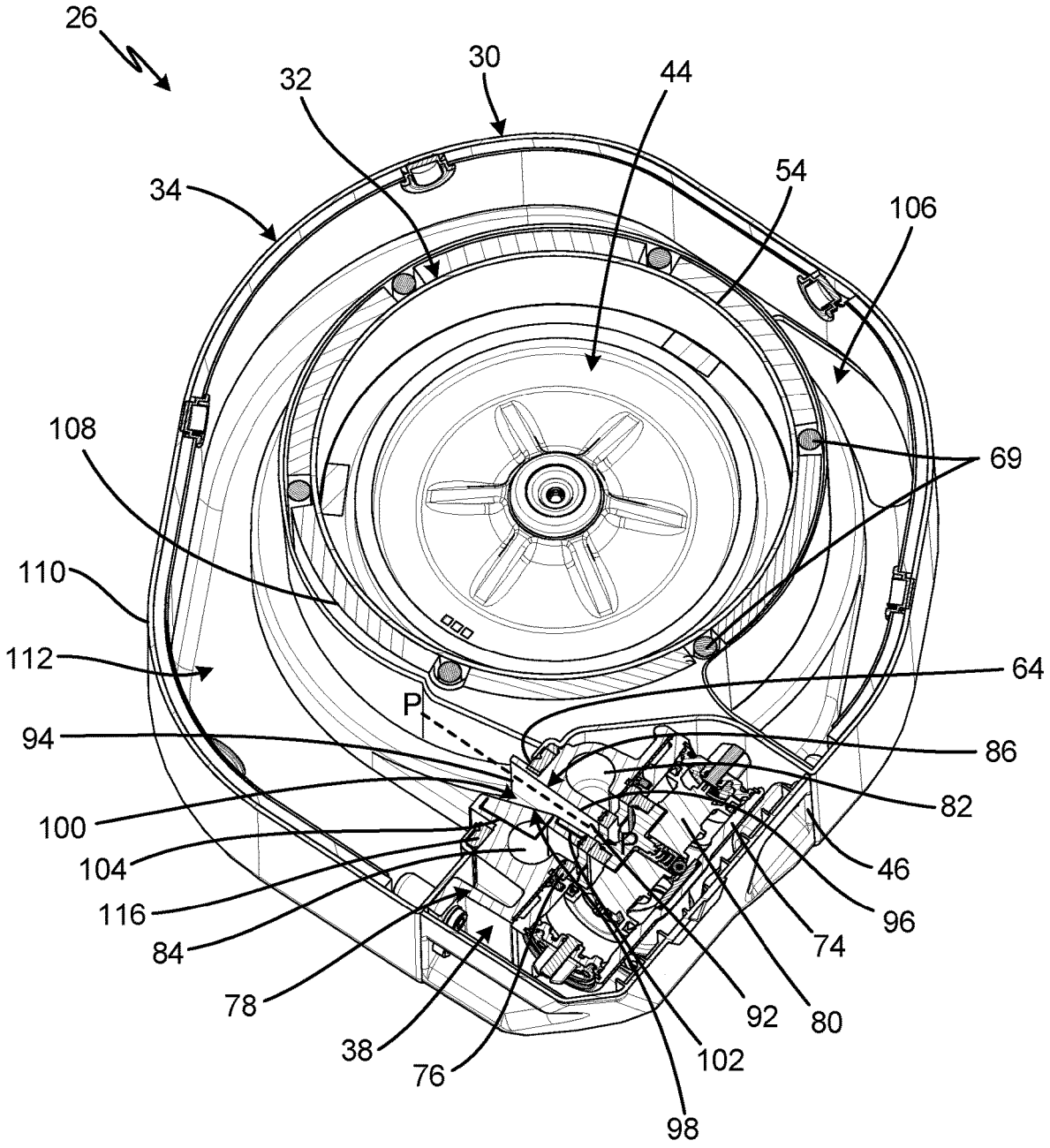
FIG. 3B is an isometric cross-sectional view of the air motor assembly of FIG. 3A taken along line B-B in FIG. 2C.
Figure 3C:
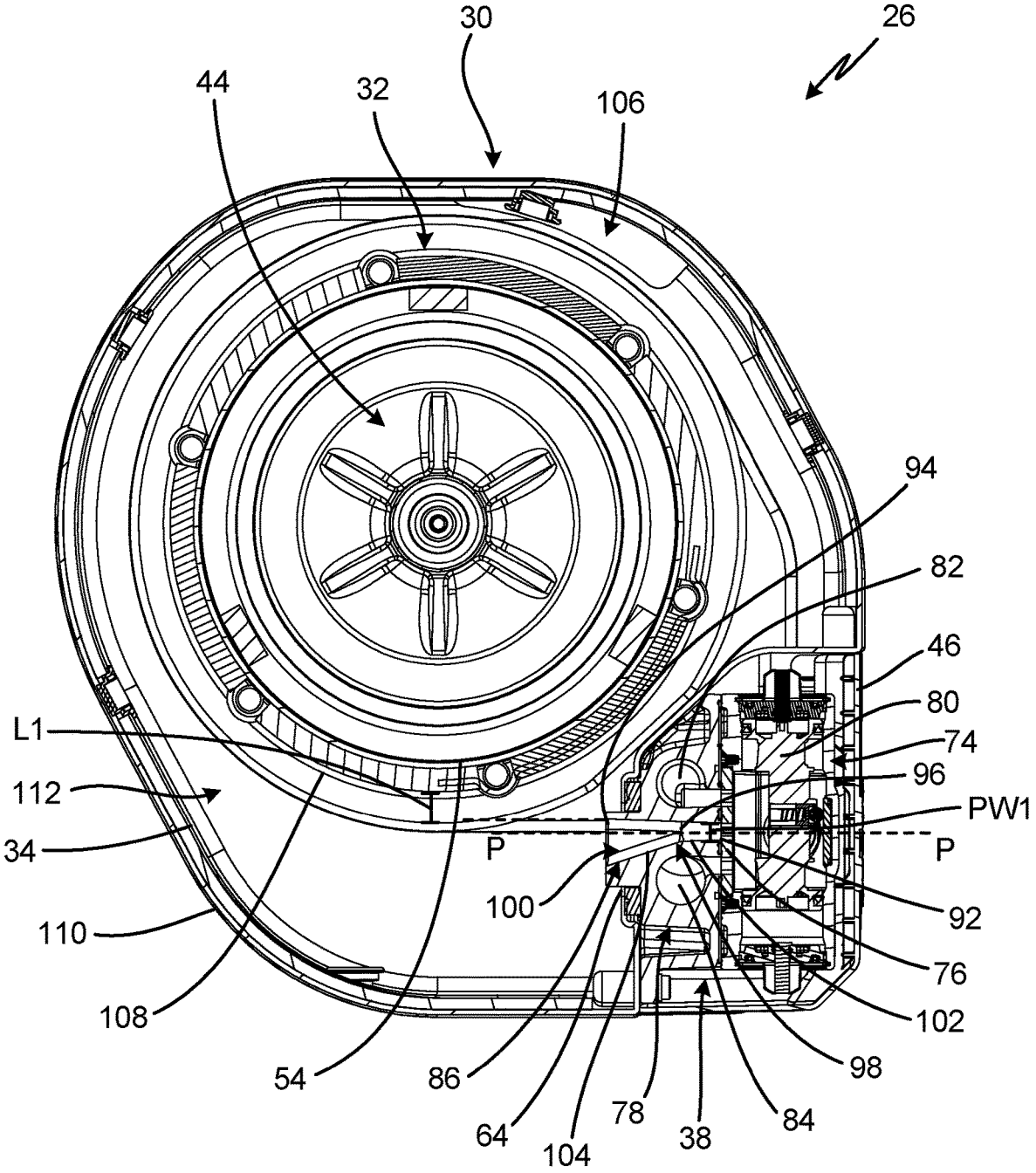
FIG. 3C is an elevation cross-sectional view of the air motor assembly of FIG. 3A taken along line B-B in FIG. 2C.
Figure 3D:
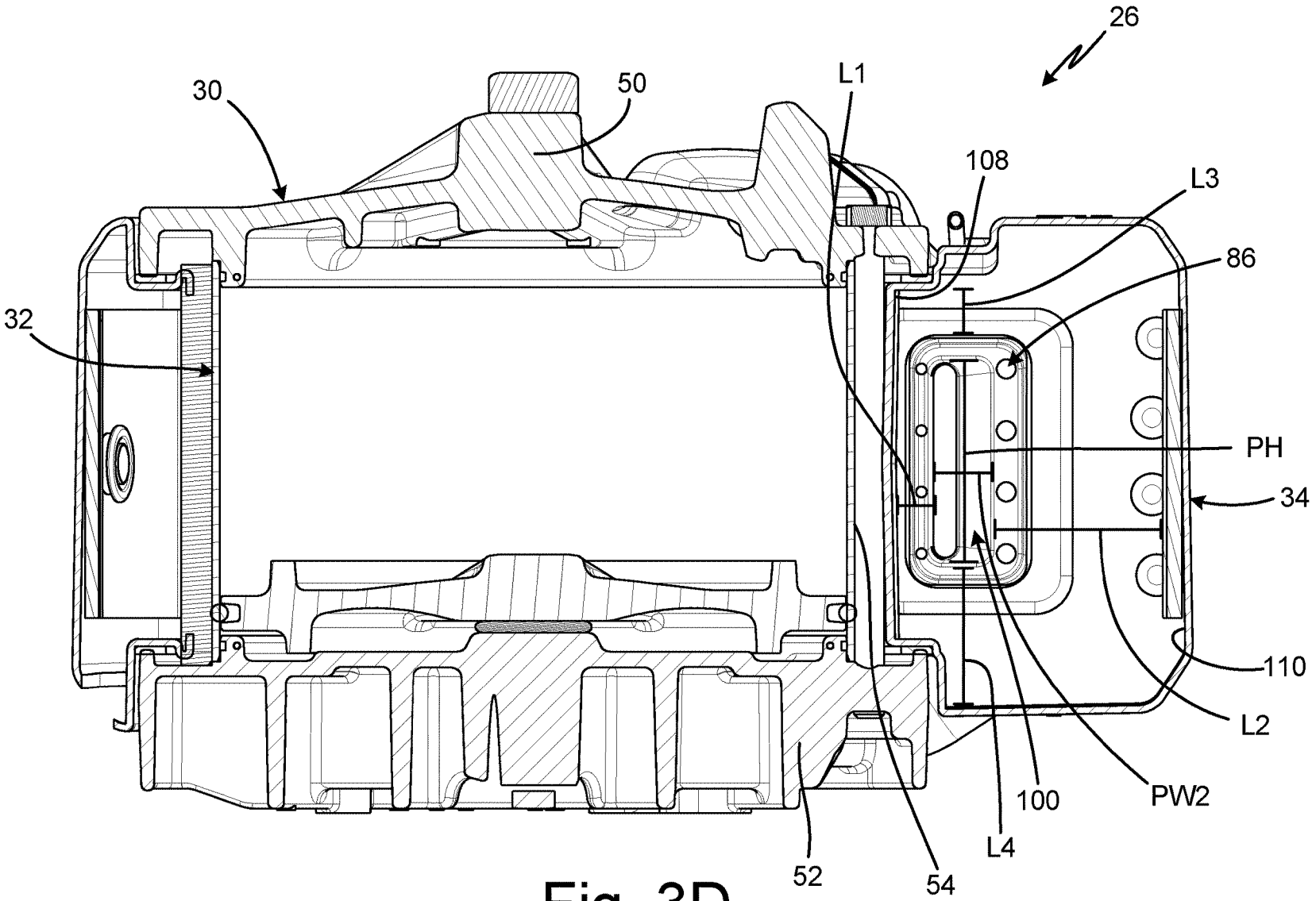
FIG. 3D is a cross-sectional view of an air motor assembly taken along line D-D in FIG. 2C.

FIG. 3A is a partially exploded view of air motor assembly 26. FIG. 3B is an isometric cross-sectional view of air motor assembly 26 taken along line B-B in FIG. 2C. FIG. 3C is a cross-sectional view of air motor assembly 26 taken along line B-B in FIG. 2C. FIG. 3D is a cross-sectional view of air motor assembly 26 taken along line C-C in FIG. 2C. FIGS. 3A-3D will be discussed together. Air motor 30, control valve 38 (FIGS. 3A-3C), poppet valve 40*a* (FIG. 3A), poppet line 42*a* (FIG. 3A), and poppet line 42*b* (FIG. 3A) of air motor assembly 26 are shown. Air motor 30 includes motor cylinder 32, exhaust manifold 34, connecting rod 36 (FIG. 3A), piston 44 (FIGS. 3B and 3C), valve cover 46 (FIGS. 3A-3C), and loop 48 (FIG. 3A). Motor cylinder 32 includes upper cylinder housing 50 (FIGS. 3A and 3D), lower cylinder housing 52 (FIGS. 3A and 3D), and cylinder sleeve 54 (FIGS. 3B-3D). Upper cylinder housing 50 includes upper port 56 (FIG. 3A). Lower cylinder housing 52 includes lower port 58 (FIG. 3A). Control valve 38 includes valve housing 74, valve gasket 76, exhaust block 78, and shuttle 80 (FIGS. 3B and 3C). Valve housing 74 includes air inlet 60 (FIG. 3A) and poppet ports 62*a*-62*b* (FIG. 3A). Exhaust block 78 includes first port 82 (FIGS. 3B and 3C), second port 84 (FIGS. 3B and 3C), exhaust port 86 (FIGS. 3B-3D), first arm 88 (FIG. 3A), and second arm 90 (FIG. 3A). Exhaust port 86 includes port inlet 92, port outlet 94, first sidewall 96, second sidewall 98, and expansion chamber 100. Second sidewall 98 includes upstream portion 102 and downstream portion 104. Exhaust manifold 34 includes exhaust inlet 64, exhaust outlet 106 (FIGS. 3B and 3C), inner wall 108, outer wall 110, and exhaust passage 112.

Exhaust manifold 34 is mounted on motor cylinder 32. Exhaust inlet 64 extends into exhaust manifold 34 and is configured to receive exhaust gas from control valve 38. Exhaust passage 112 extends through exhaust manifold 34 between inner wall 108 and outer wall 110 and provide a flowpath for exhaust to flow from exhaust inlet 64 to exhaust outlet 106. Exhaust outlet 106 extends into exhaust manifold 34 at an opposite end of exhaust passage 112 from exhaust inlet 64, and exhaust outlet 106 is configured to expel the exhaust gas to the atmosphere.

Upper cylinder housing 50 is disposed on top of cylinder sleeve 54 and lower cylinder housing 52 is disposed below cylinder sleeve 54. Cylinder sleeve 54 is clamped between upper cylinder housing 50 and lower cylinder housing 52 by fasteners 69 extending through upper cylinder housing 50 into lower cylinder housing 52. Upper port 56 extends into upper cylinder housing 50, and lower port 58 extends into lower cylinder housing 52. Poppet valve 40*a* is disposed on upper cylinder housing 50. Poppet line 42*a* extends from poppet valve 40*a* to poppet port 62*a* of valve housing 74. Poppet valve 40*b* is disposed on lower cylinder housing 52. Poppet line 42*b* extends from poppet valve 40*b* to poppet port 62*b* of valve housing 74.

Fasteners 114*a* extend through valve housing 74 and valve gasket 76 into exhaust block 78. Fasteners 114*b* extend through exhaust block 78 into exhaust manifold 34 to secure control valve 38 to exhaust manifold 34. Exhaust gasket 116 is disposed between exhaust block 78 and exhaust manifold 34 and extends around exhaust inlet 64. First arm 88 projects from exhaust block 78 and is attached to upper cylinder housing 50 by fasteners 114*c*. First arm 88 provides a flowpath for air to flow between exhaust block 78 and upper cylinder housing 50. Second arm 90 projects from exhaust block 78 and is attached to lower cylinder housing 52 by fasteners 114*c*. Second arm 90 provides a flowpath for air to flow between exhaust block 78 and upper cylinder housing 50. Valve cover 46 is disposed over control valve 38 and is attached to exhaust manifold 34 by fasteners 114*d*.

Shuttle 80 is disposed within valve housing 74. Shuttle 80 directs air from air inlet 60 to first port 82 and second port 84 in an alternating manner to drive piston 44 through the upstroke and downstroke. Shuttle 80 directs exhaust gas from the other one of first port 82 and second port 84 to exhaust port 86. Valve gasket 76 is disposed between exhaust block 78 and valve housing 74 and provides a surface for shuttle 80 to seal against when directing the air.

Exhaust port 86 extends through exhaust block 78 along port axis P-P. Exhaust port 86 provides a flow path for exhaust gas to flow from valve housing 74 to exhaust manifold 34. Exhaust port 86 is defined between first sidewall 96 and second sidewall 98. Upstream portion 102 of second sidewall 98 extends from port inlet 92 towards exhaust manifold 34. Downstream portion 104 of second sidewall 98 extends from upstream portion 102 to port outlet 94 of exhaust block 78.

First sidewall 96 extends axially along port axis P-P between port inlet 92 and port outlet 94. Upstream portion 102 also extends axially along port axis P-P between port inlet 92 and port outlet 94. As such, the portion of exhaust port 86 between upstream portion 102 and first sidewall 96 has a substantially constant width PW1 (FIG. 3C). Downstream portion 104 of second sidewall 98 extends transverse to port axis P-P. Port outlet 94 has a width PW2 (FIG. 3D) greater than width PW1. As shown in FIG. 3D, port outlet 94 has height PH, which is larger than width PW2 of port outlet 94. Moreover, port outlet 94 is spaced from inner wall 108 of exhaust manifold 34 by length L1, spaced from outer wall 110 of exhaust manifold 34 by length L2, spaced from the top of exhaust manifold 34 by length L3, and spaced from the bottom of exhaust manifold 34 by length L4. Spacing port outlet 94 from each wall of exhaust manifold 34 allows for further expansion and cooling of the exhaust gas prior to impinging on any surface of exhaust manifold 34.

Downstream portion 104 and first sidewall 96 define expansion chamber 100 through exhaust port 86. Expansion chamber 100 expands away from inner wall 108 of exhaust manifold 34 such that the exhaust gasses flow tangential to or away from inner wall 108. Having expansion chamber 100 expand away from inner wall 108 prevents the exhaust gasses from impinging on inner wall 108. Expansion chamber 100 extends towards outer wall 110, which is exposed to the atmosphere and thus less susceptible to icing than inner wall 108.

First sidewall 96 is disposed tangential to inner wall 108 of exhaust manifold 34. As shown, first sidewall 96 is spaced from inner wall 108 by offset length L1. It is understood that length L1 can be any desired length greater than or equal to zero. Having offset length L1 greater than or equal to zero ensures that the exhaust gas exiting exhaust port 86 does not impinge on inner wall 108.

During operation, air supply 16 (FIG. 1) provides compressed air to valve housing 74. Motor cylinder 32 cools substantially during operation due to the Venturi effect and the Ideal Gas Law. Inner wall 108 of exhaust manifold 34 also cools significantly due to conduction from cylinder sleeve 54. With shuttle 80 in the position shown in FIG. 3B, shuttle 80 directs the air received from air supply 16 to first port 82. The compressed air enters first port 82 and flows through first arm 88 to upper port 56. The compressed air enters cylinder sleeve 54 through upper port 56 and drives piston 44 through a downstroke.

As piston 44 is driven through the downstroke, piston 44 drives exhaust gas out of cylinder sleeve 54 through lower port 58. The exhaust gas flows through second arm 90 and enters exhaust block 78 through second port 84. Shuttle 80 directs the exhaust gas from second port 84 to exhaust port 86.

The exhaust air enters exhaust port 86 through port inlet 92 and flows between first sidewall 96 and second sidewall 98. Expansion chamber 100 between downstream portion 104 of second sidewall 98 and first sidewall 96 causes a pressure drop in the exhaust gas. The pressure drop causes a temperature drop in the exhaust gas. The temperature drop causes the water vapor within the exhaust gas to freeze into ice particles before the exhaust gas impinges on exhaust manifold 34, preventing ice from accumulating within exhaust manifold 34. The ice particles are carried through exhaust passage 112 by the exhaust gas and are ejected from exhaust manifold 34 through exhaust outlet 106.

When piston 44 reaches the end of the downstroke, piston 44 impacts rod 164*b* (FIG. 6B) of poppet valve 40*b*, thereby opening poppet valve 40*b* and allowing air within poppet line 42*b* to vent through poppet valve 40*b*.

The air pressure within poppet line 42*a* causes shuttle 80 to shift positions within valve housing 74, such that shuttle 80 directs the air from air supply 16 to second port 84 and fluidly connects first port 82 and exhaust port 86. The compressed air enters second port 84 and flows through second arm 90 to lower port 58. The compressed air enters cylinder sleeve 54 through lower port 58 and drives piston 44 through an upstroke.

As piston 44 is driven through the upstroke, piston 44 drives exhaust gas out of cylinder sleeve 54 through upper port 56. The exhaust gas flows through first arm 88 and enters exhaust block 78 through first port 82. Shuttle 80 directs the exhaust air from first port 82 to exhaust port 86. Expansion chamber 100 causes a pressure drop in the exhaust gas, which causes a temperature drop in the exhaust gas. The temperature drop causes the water vapor within the exhaust gas to freeze into ice particles before the exhaust gas impinges on exhaust manifold 34. The ice particles are carried through exhaust passage 112 by the exhaust gas and are ejected from exhaust manifold 34 through exhaust outlet 106. By causing the water vapor to freeze prior to impinging on exhaust manifold 34, expansion chamber 100 prevents ice accumulation within exhaust manifold 34.

Exhaust port 86 provides significant advantages. Orienting exhaust port 86 on axis P-P tangential to inner wall 108 of exhaust manifold 34 prevents the exhaust gas from impinging on exhaust manifold 34. Preventing impingement allows the water vapor to freeze in the air instead of on any surface of exhaust manifold 34, which prevents ice buildup. In addition, expansion chamber 100 between downstream portion 104 of second sidewall 98 and first sidewall 96 causes the pressure drop, which causes the temperature drop that allows the water vapor to freeze prior to impinging on exhaust manifold 34. Moreover, orienting first sidewall 96 substantially axial with port axis P-P and downstream portion 104 transverse to port axis P-P causes the exhaust gas to expand away from inner wall 108, further discouraging icing on inner wall 108. Spacing first sidewall 96 from inner wall 108 by offset length L1 further prevents the exhaust gas from impinging on inner wall 108 as the exhaust gas exits expansion chamber 100.

Figure 4A:
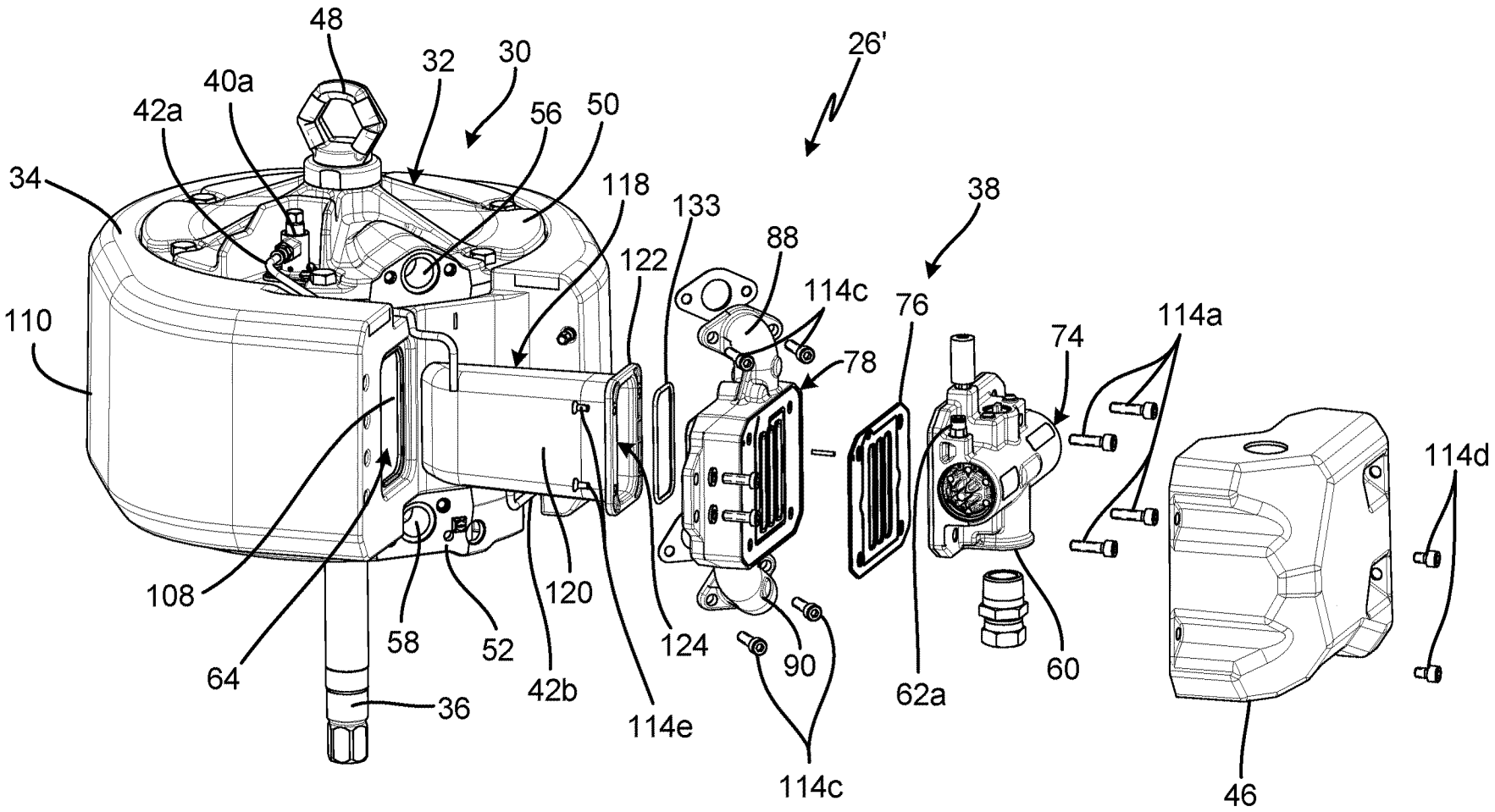
FIG. 4A is a partially exploded view of an air motor assembly.
Figure 4B:
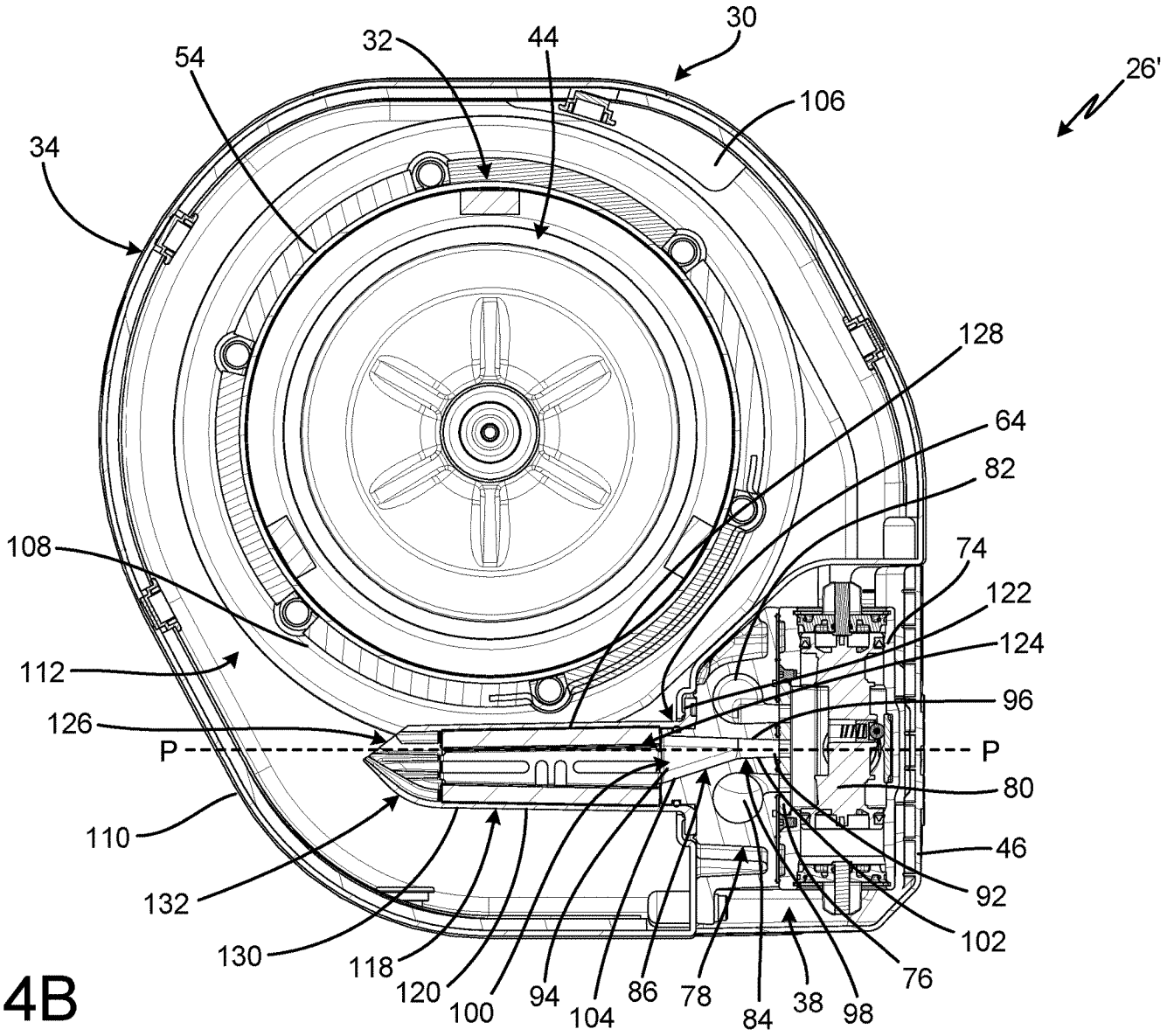
FIG. 4B is a cross-sectional view of the air motor assembly shown in FIG. 4A.

FIG. 4A is a partially exploded view of air motor assembly 26'. FIG. 4B is a cross-sectional view of air motor assembly 26'. FIGS. 4A and 4B will be discussed together. Air motor assembly 26' includes air motor 30, control valve 38, poppet valve 40*a* (FIG. 4A), poppet valve 40*b* (not shown), poppet lines 42*a*-42*b* (FIG. 4A), and exhaust chute 118. Air motor 30 includes motor cylinder 32, exhaust manifold 34, connecting rod 36 (FIG. 4A), piston 44 (FIG. 4B), valve cover 46, and loop 48 (FIG. 4A). Motor cylinder 32 includes upper cylinder housing 50 (FIG. 4A), lower cylinder housing 52 (FIG. 4A), and cylinder sleeve 54 (FIG. 4B). Upper cylinder housing 50 includes upper port 56 (FIG. 4A). Lower cylinder housing 52 includes lower port 58 (FIG. 4A). Control valve 38 includes valve housing 74, valve gasket 76, exhaust block 78, and shuttle 80 (FIG. 4B). Air inlet 60 (FIG. 4A) and poppet port 62*a* (FIG. 4A) of valve housing 74 are shown. Exhaust block 78 includes first port 82 (FIG. 4B), second port 84 (FIG. 4B), exhaust port 86 (FIG. 4B), first arm 88 (FIG. 4A), and second arm 90 (FIG. 4A). Exhaust port 86 includes port inlet 92 (FIG. 4B), port outlet 94 (FIG. 4B), first sidewall 96 (FIG. 4B), second sidewall 98 (FIG. 4B), and expansion chamber 100 (FIG. 4B). Second sidewall 98 includes upstream portion 102 (FIG. 4B) and downstream portion 104 (FIG. 4B). Exhaust manifold 34 includes exhaust inlet 64, exhaust outlet 106 (FIG. 4B), inner wall 108, outer wall 110, and exhaust passage 112 (FIG. 4B). Exhaust chute 118 includes chute body 120, chute flange 122, chute inlet 124, and chute outlet 126 (FIG. 4B). Chute body 120 includes first chute wall 128 (FIG. 4B) and second chute wall 130 (FIG. 4B). Second chute wall 130 includes curved portion 132 (FIG. 4B).

Air motor assembly 26' is substantially similar to air motor assembly 26 (best seen in FIGS. 3A-3D), except air motor assembly 26' further includes exhaust chute 118. Exhaust chute 118 extends into exhaust passage 112 of exhaust manifold 34 through exhaust inlet 64. Chute flange 122 is disposed between exhaust block 78 and exhaust manifold 34. Exhaust chute 118 is connected to exhaust block 78 by fasteners 114*e* extending through chute flange 122 into exhaust block 78. Chute seal 133 is disposed between chute flange 122 and exhaust block 78. Chute body 120 extends through exhaust inlet 64 into exhaust passage 112. Chute inlet 124 is disposed adjacent port outlet 94 to receive exhaust gas from port outlet 94. Chute outlet 126 is disposed at an opposite end of chute body 120 from chute inlet 124. First chute wall 128 extends substantially axially along port axis P-P. Second chute wall 130 also extends substantially axially along port axis P-P from chute inlet 124 to curved portion 132. Curved portion 132 is disposed at a distal end of second chute wall 130 proximate chute outlet 126. Curved portion 132 is transverse to port axis P-P and is configured to guide the exhaust gas into exhaust passage 112.

During operation, the exhaust gas from exhaust port 86 enters exhaust chute 118 through chute inlet 124. Exhaust chute 118 guides the exhaust gas past the portion of inner wall 108 nearest exhaust port 86. Curved portion 132 turns the exhaust gas such that the exhaust gas flows tangential to inner wall 108 when the exhaust gas is expelled through chute outlet 126. Exhaust chute 118 reduces noise caused by the expanding exhaust gas flowing through exhaust port 86 and further prevents icing on surfaces of exhaust manifold 34.

Figure 5B:
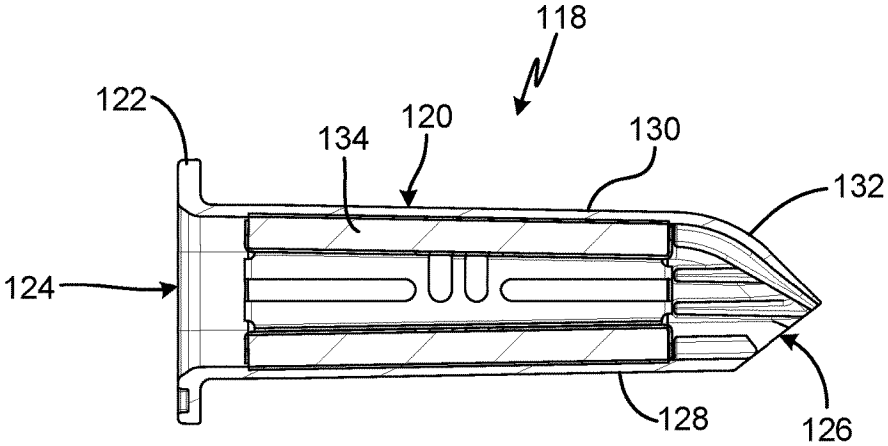
FIG. 5B is a cross-sectional view of the exhaust chute of FIG. 5A taken along line B-B in FIG. 5A.
Figure 5A:
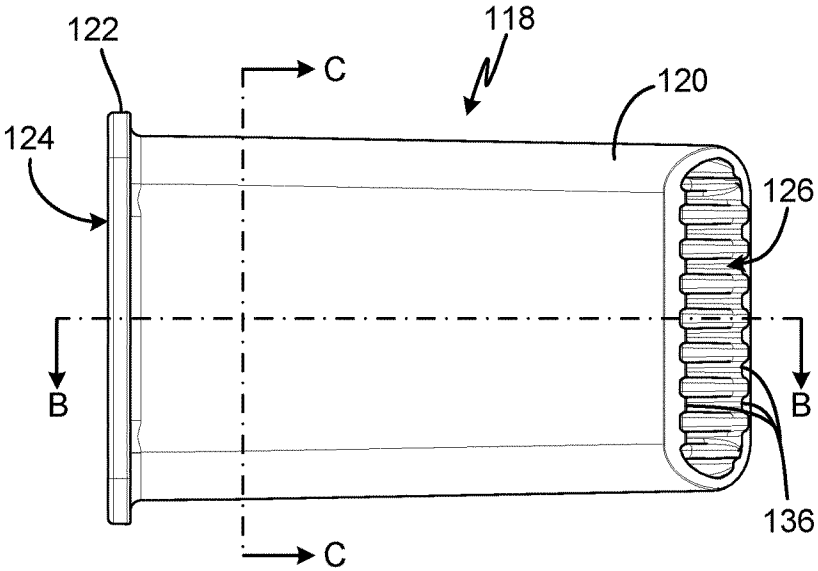
FIG. 5A is a side elevation view of an exhaust chute.
Figure 5C:
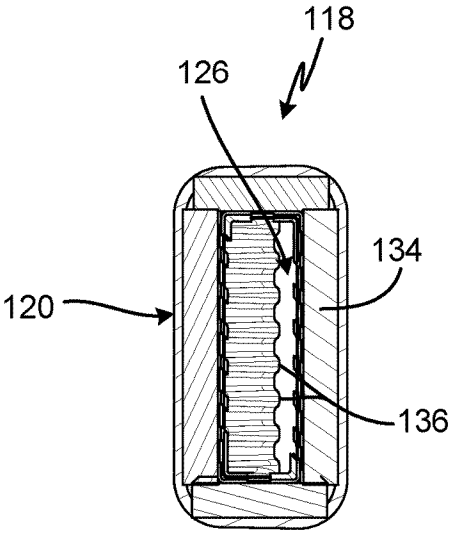
FIG. 5C is a cross-sectional view of the exhaust chute of FIG. 5A taken along line C-C in FIG. 5A.

FIG. 5A is a side elevation view of exhaust chute 118. FIG. 5B is a cross-sectional view of exhaust chute 118 taken along line B-B in FIG. 5A. FIG. 5C is a cross-sectional view of exhaust chute 118 taken along line C-C in FIG. 5A. FIGS. 5A-5C will be discussed together. Exhaust chute 118 includes chute body 120, chute flange 122, chute inlet 124, chute outlet 126, and liner 134. Chute body 120 includes first chute wall 128 (FIG. 5B) and second chute wall 130 (FIG. 5B). Second chute wall 130 includes curved portion 132 (FIG. 5B). Chute outlet 126 includes crenulations 136.

Exhaust chute 118 is typically made of a plastic or other non-metallic substance to lower the thermal conductivity of exhaust chute 118. Chute flange 122 extends around chute inlet 124. First chute wall 128 extends from chute inlet 124 to chute outlet 126. Second chute wall 130 extends from chute inlet 124, and curved portion 132 is disposed at chute outlet 126. Liner 134 is disposed in chute body 120. In some examples, liner 134 is a felt liner configured to reduce noise generated by the exhaust. Curved portion 132 is configured to turn air passing through exhaust chute 118. Crenulations 136 are disposed around chute outlet 126. Crenulations 136 are configured to generate turbulence in the exhaust passing through chute outlet 126 to thereby break the soundwave and decrease the noise generated by air motor assembly 26' (FIGS. 4A-4B).

Figure 6A:
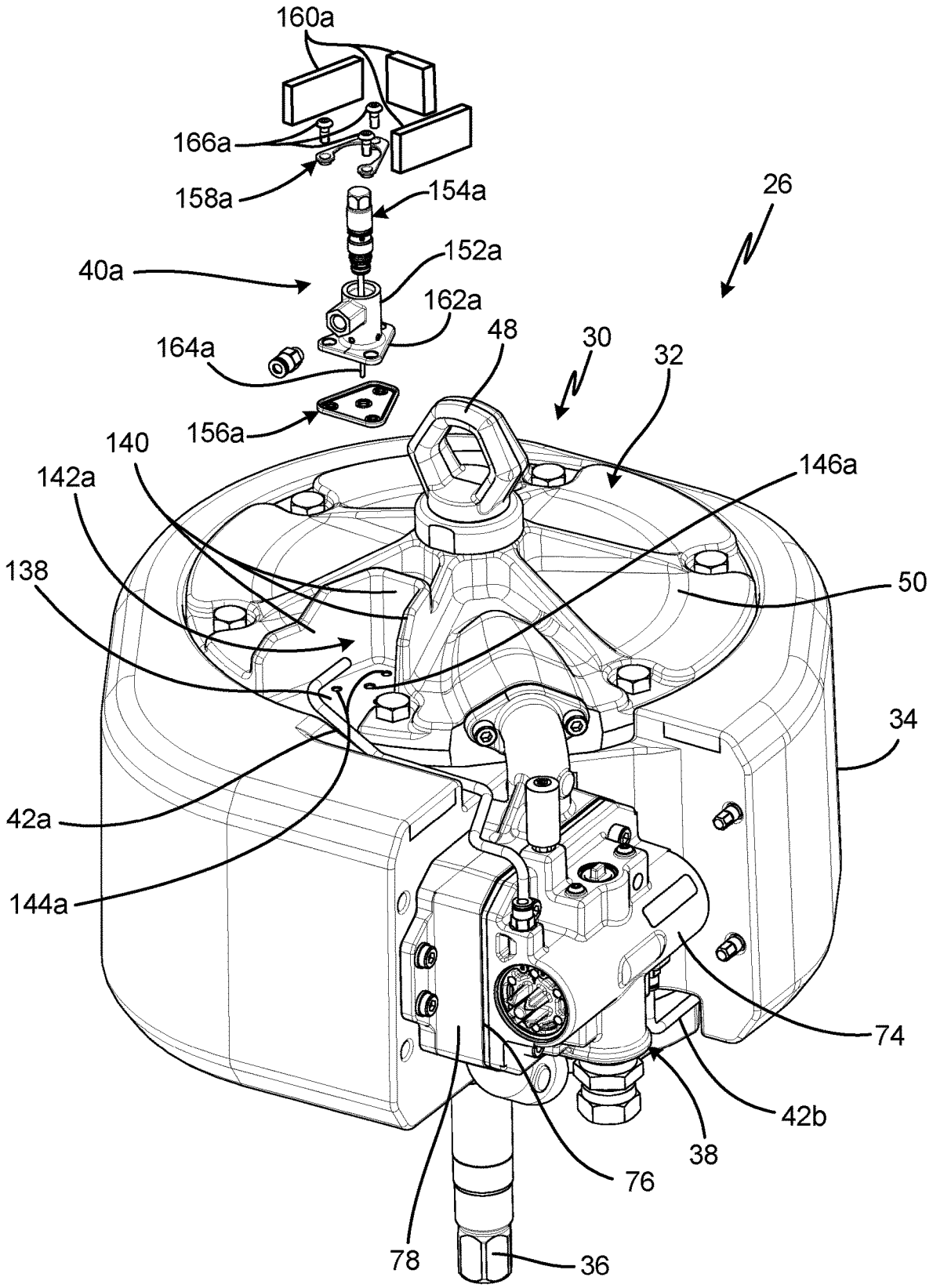
FIG. 6A is a partially exploded view of an air motor assembly.
Figure 6B:
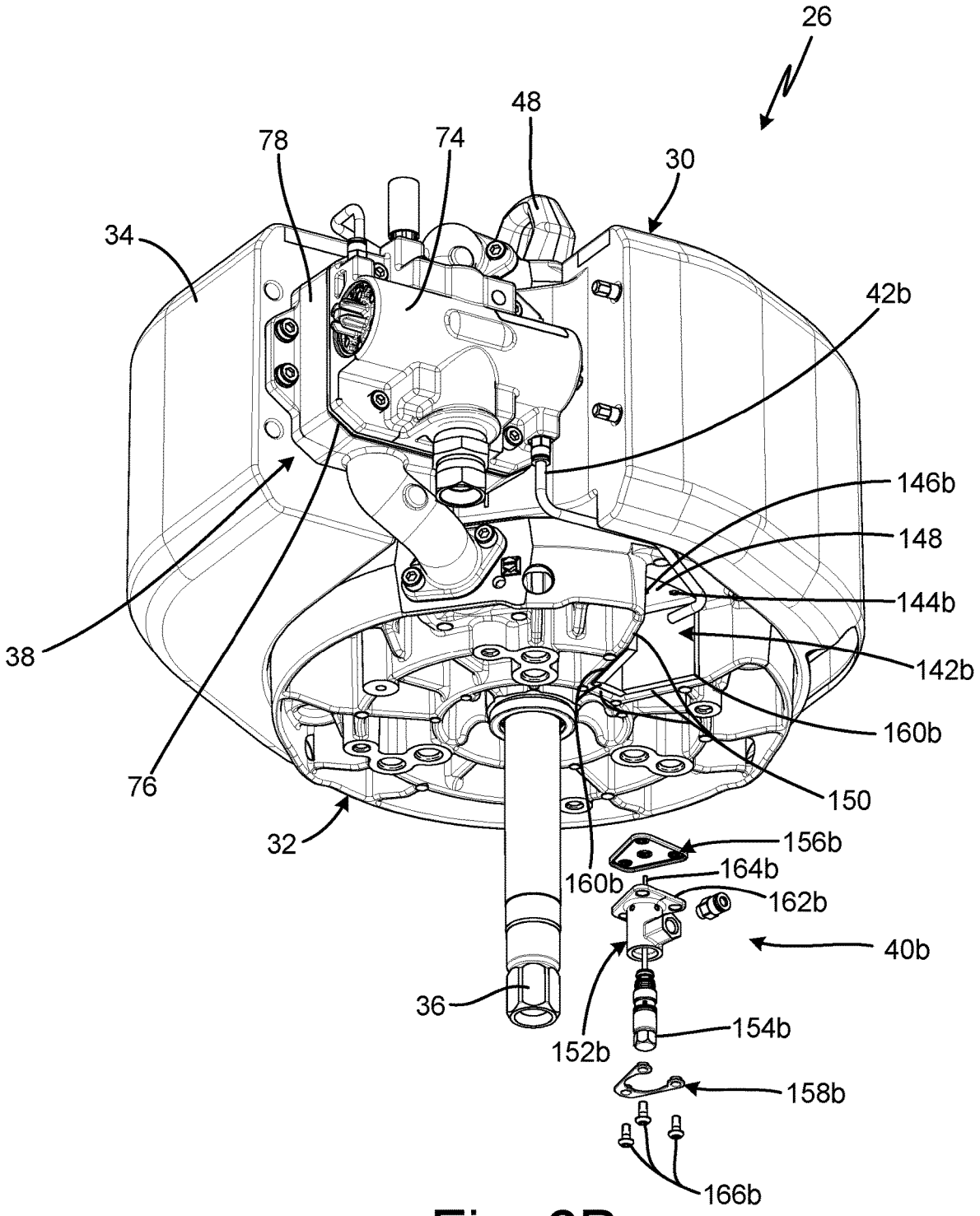
FIG. 6B is a partially exploded view of an air motor assembly.
Figure 6C:
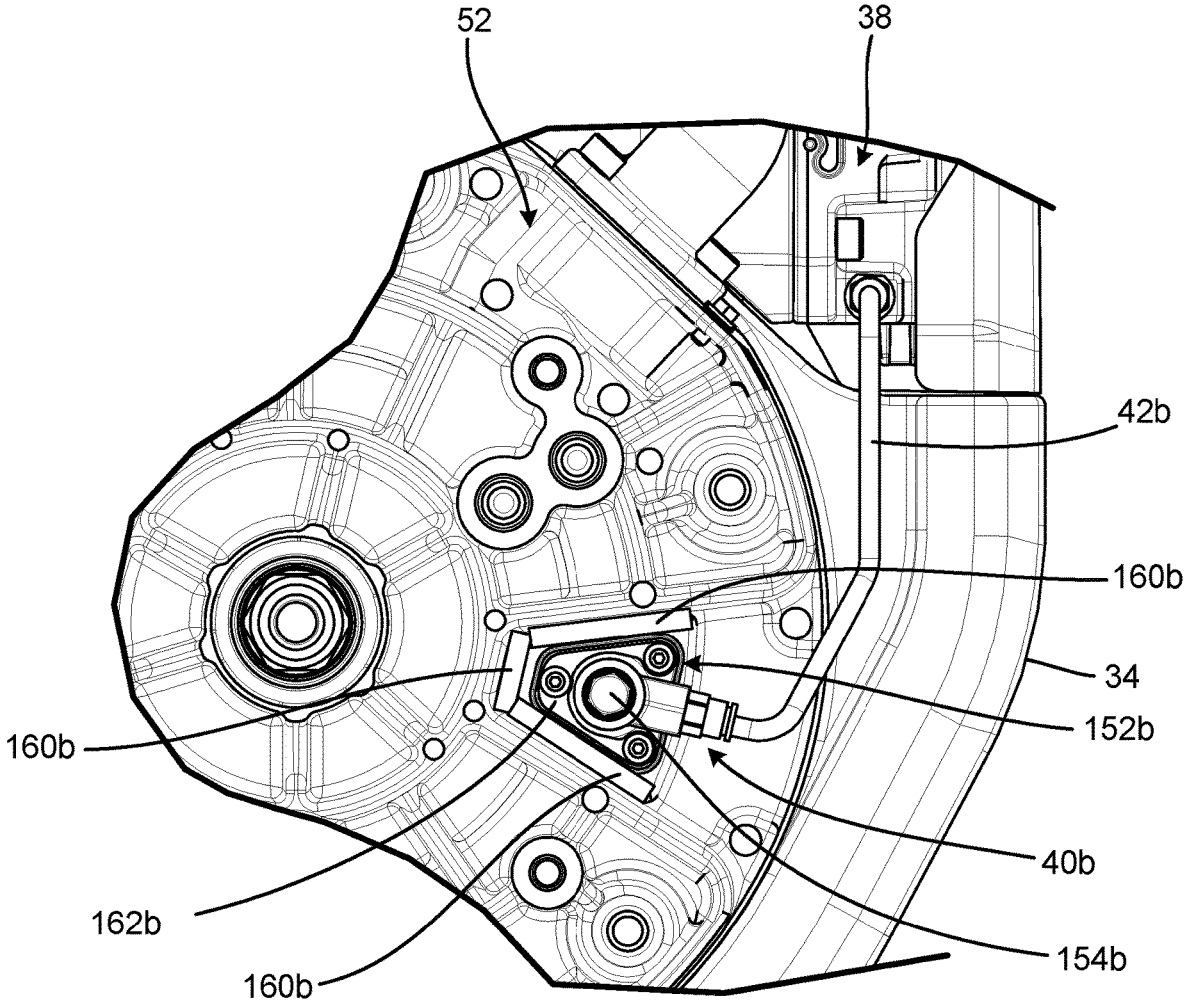
FIG. 6C is a detail elevation view of a poppet valve of an air motor assembly.

FIG. 6A is a partially exploded view of air motor assembly 26. FIG. 6B is another partially exploded view of air motor assembly 26. FIG. 6C is a detail bottom elevation view of a portion of air motor assembly 26. Air motor assembly 26 includes air motor 30, control valve 38, poppet valve 40*a* (FIG. 6A), poppet valve 40*b* (FIGS. 6B and 6C), poppet line 42*a* (FIG. 6A), and poppet line 42*b*. Motor cylinder 32, exhaust manifold 34, connecting rod 36, and loop 48 of air motor 30 are shown. Upper cylinder housing 50 (FIG. 6A) and lower cylinder housing 52 (FIGS. 6B and 6C) of motor cylinder 32 are shown. Valve housing 74, valve gasket 76, and exhaust block 78 of control valve 38 are shown.

Top surface 138, upper walls 140, and poppet receiving area 142*a* of upper cylinder housing 50 are shown in FIG. 6A. Top surface 138 includes fastener openings 144*a* (FIG. 6A) and rod opening 146*a* (FIG. 6A). Poppet valve 40*a* includes poppet housing 152*a* (FIG. 6A), valve assembly 154*a* (FIG. 6A), first gasket 156*a* (FIG. 6A), second gasket 158*a* (FIG. 6A), and insulating sheets 160*a* (FIG. 6A). Poppet housing 152*a* includes mounting flange 162*a* (FIG. 6A). Valve assembly 154*a* includes rod 164*a* (FIG. 6A).

Bottom surface 148, lower walls 150, and poppet receiving area 142*b* of lower cylinder housing 52 are shown in FIG. 6B. Bottom surface 148 includes fastener openings 144*b* (FIG. 6B) (only one of which is shown) and rod opening 146*b* (FIG. 6B). Poppet valve 40*b* includes poppet housing 152*b* (FIGS. 6B and 6C), valve assembly 154*b* (FIGS. 6B and 6C), first gasket 156*b* (FIG. 6B), second gasket 158*b* (FIG. 6B), and insulating sheets 160*b* (FIGS. 6B and 6C). Poppet housing 152*b* includes mounting flange 162*b* (FIGS. 6B and 6C). Valve assembly 154*b* includes rod 164*b* (FIG. 6B).

Exhaust manifold 34 is disposed around motor cylinder 32. Upper cylinder housing 50 is disposed on a top side of cylinder sleeve 54 (best seen in FIG. 2D). Fastener openings 144*a* extend into top surface 138 and rod opening 146*a* extends through top surface 138. Upper walls 140 extend from top surface 138 of upper cylinder housing 50 and partially surround poppet valve 40*a*. Upper walls 140 define poppet receiving area 142*a*. Upper walls 140 protect poppet valve 40*a* from undesired contact during operation.

Poppet valve 40*a* is mounted on top surface 138 within poppet receiving area 142*a*. Insulating sheets 160*a* are disposed between poppet valve 40*a* and upper walls 140 to thermally isolate poppet valve 40*a* from upper walls 140. First gasket 156*a* is disposed between top surface 138 and mounting flange 162 of poppet housing 152*a* to thermally insulate poppet housing 152*a* from upper cylinder housing 50. Second gasket 158*a* is disposed on an opposite side of mounting flange 162*a* from first gasket 156*a*. Fasteners 166*a* extend through second gasket 158*a*, mounting flange 162*a*, and first gasket 156*a* and into fastener openings 144*a* in top surface 138 to connect poppet valve 40*a* to upper cylinder housing 50. Second gasket 158*a* prevents the heads of fasteners 166*a* from contacting mounting flange 162*a*.

As discussed above, motor cylinder 32 experiences significant cooling during operation. First gasket 156*a*, second gasket 158*a*, and insulating sheets 160*a* thermally isolate poppet valve 40*a* from upper cylinder housing 50 to prevent icing in poppet valve 40*a*. With poppet valve 40*a* secured to top surface 138 by fasteners 166*a*, the only conduction path between upper cylinder housing 50 and poppet valve 40*a* is at the interface of fasteners 166*a* and mounting flange 162*a* where fasteners 166*a* extend through mounting flange 162*a*. It is understood, however, that a bushing formed from a thermal insulation material can be placed in the fastener openings extending through mounting flange 162*a* to fully thermally isolate poppet valve 40*a* from upper cylinder housing 50.

Poppet line 42*a* extends from poppet housing 152*a* to control valve 38. Poppet line 42*a* contains pressurized air that controls the actuation of shuttle 80 (best seen in FIG. 3B) within valve housing 74. Poppet line 42*a* is external to motor cylinder 32, which thermally isolates poppet line 42*a* from motor cylinder 32 and exposes poppet line 42*a* to the atmosphere. Disposing poppet line 42*a* external to motor cylinder 32 prevents icing within poppet line 42*a*.

Lower cylinder housing 52 is disposed on a bottom side of cylinder sleeve 54 (best seen in FIG. 2D). Fastener openings 144*b* extend into bottom surface 148 and rod opening 146*b* extends through bottom surface 148. Lower walls 150 extend from bottom surface 148 of lower cylinder housing 52 and partially surround poppet valve 40*b*. Lower walls 150 define poppet receiving area 142*b*. Poppet valve 40*b* is mounted on bottom surface 148 within poppet receiving area 142*b*. Lower walls 150 protect poppet valve 40*b* from undesired contact during operation.

Insulating sheets 160*b* are disposed between poppet valve 40*b* and lower walls 150 to thermally isolate poppet valve 40*b* from lower walls 150. First gasket 156*b* is disposed between bottom surface 148 and mounting flange 162*b* of poppet housing 152*b* to thermally insulate poppet housing 152*b* from lower cylinder housing 52. Second gasket 158*b* is disposed on an opposite side of mounting flange 162*b* from first gasket 156*b*. Fasteners 166*b* extend through second gasket 158*b*, mounting flange 162*b*, and first gasket 156*b* and into bottom surface 148 to secure poppet valve 40*b* to lower cylinder housing 52. Second gasket 158*b* prevents the heads of fasteners 166*b* from contacting mounting flange 162*b*.

First gasket 156*b*, second gasket 158*b*, and insulating sheets 160*b* thermally isolate poppet valve 40*b* from lower cylinder housing 52 during operation. With poppet valve 40*b* secured to bottom surface 148 by fasteners 166*b*, the only conduction path between lower cylinder housing 52 and poppet valve 40*b* is at the interface of fasteners 166*b* and mounting flange 162*b* where fasteners 166*b* extend through mounting flange 162*b*. It is understood, however, that a bushing formed from a thermal insulation material can be placed in the fastener openings extending through mounting flange 162*b* to fully thermally isolate poppet valve 40*b* from lower cylinder housing 52.

Poppet line 42*b* extends from poppet housing 152*b* to control valve 38. Poppet line 42*b* contains pressurized air that controls the actuation of shuttle 80 within valve housing 74. Poppet line 42*b* is disposed external to motor cylinder 32, which thermally isolates poppet line 42*b* from motor cylinder 32 and exposes poppet line 42*b* to the atmosphere. Disposing poppet line 42*b* external to motor cylinder 32 prevents icing within poppet line 42*b*.

Thermally isolating poppet valves 40*a*, 40*b* and poppet lines 42*a*, 42*b* from motor cylinder 32 provides significant advantages. First gasket 156 and second gasket 158 lower the thermal conductivity between motor cylinder 32 and poppet valves 40*a*, 40*b* by limiting the surface area of poppet valves 40*a*, 40*b* in contact with motor cylinder 32. Limiting contact inhibits ice formation in poppet valves 40*a*, 40*b* that can cause air motor 30 to seize. In addition, poppet valves 40*a*, 40*b* being on the exterior of motor cylinder 32 exposes poppet valves 40*a*, 40*b* to the ambient environment, which further inhibits icing in poppet valves 40*a*, 40*b*. Poppet lines 42*a*, 42*b* being external to motor cylinder 32 also inhibits icing by thermally isolating poppet lines 42*a*, 42*b* from motor cylinder 32. While air motor assembly 26 is described as including both insulating sheets 160*a*, 160*b*, it is understood that air motor assembly 26 can include only one set of insulating sheets 160*a*, 160*b*. In some examples, air motor assembly 26 includes insulating sheets 160*b* on a bottom of air motor assembly 26 but not insulating sheets 160*a*.

Figure 7B:
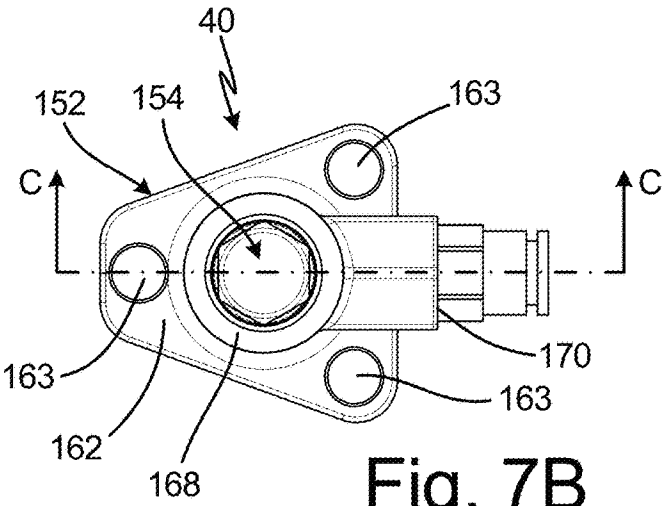
FIG. 7B is a top elevation view of a poppet valve.
Figure 7C:
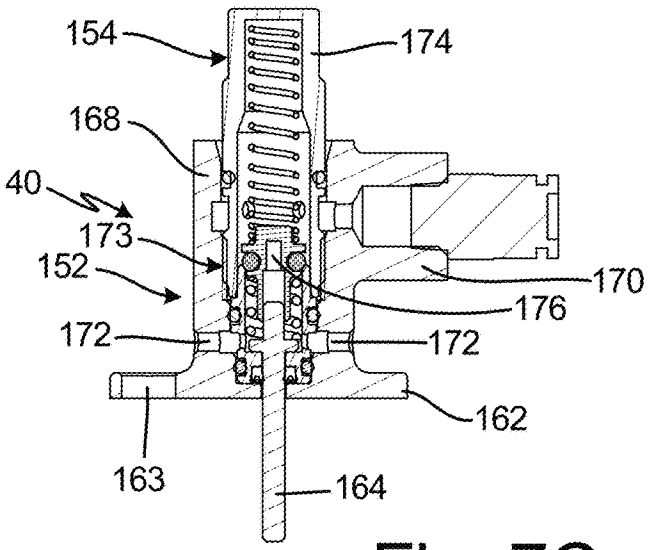
FIG. 7C is a cross-sectional view of a poppet valve taken along line C-C in FIG. 7B.
Figure 7A:
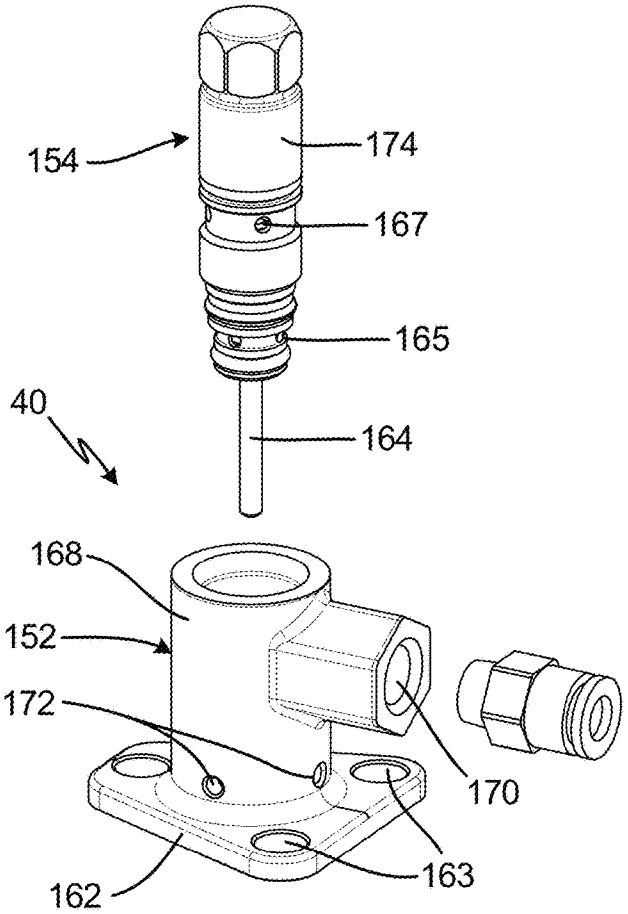
FIG. 7A is an exploded view of a poppet valve.

FIG. 7A is a partially exploded view of poppet valve 40. FIG. 7B is a top elevation view of poppet valve 40. FIG. 7C is a cross-sectional view of poppet valve 40 taken along line C-C in FIG. 7B. FIGS. 7A-7C will be discussed together. Poppet housing 152 and valve assembly 154 of poppet valve 40 are shown. Poppet housing 152 includes mounting flange 162, receiving cylinder 168, and line port 170. Mounting flange 162 includes fastener openings 163. Receiving cylinder 168 includes vents 172. Valve assembly 154 includes valve body 174 and valve member 176 (FIG. 7C). Valve member 176 includes rod 164.

Valve receiving cylinder 168 extends from mounting flange 162. Line port 170 extends from valve receiving cylinder 168 and is configured to receive poppet line 42 (best seen in FIGS. 6A-6B). Vents 172 extends into valve receiving cylinder 168 and provide a flowpath for air to be vented to the environment from valve receiving cylinder 168. Fastener openings 163 extend through mounting flange 162 and receive fasteners to secure poppet valve 40 to motor cylinder 32 (best seen in FIG. 2D).

Valve assembly 154 is removably disposed in valve receiving cylinder 168. In some examples, valve assembly 154 is secured within valve receiving cylinder 168 by interfacing threads on valve body 174 and valve receiving cylinder 168. Valve member 176 is disposed within valve body 174. Rod 164 projects out of poppet housing 152 and is configured to extend into an interior of motor cylinder 32.

Valve member 176 is normally closed, and is movable between a closed position, shown in FIG. 7C, and an open position. In the closed position, valve member 176 fluidly isolates vents 172 from poppet line 42 to prevent air from exiting valve member 176 through vents 172. During operation, rod 164 is impacted by piston 44 (best seen in FIG. 2D) to drive valve member 176 from the closed position to the open position. In the open position, a flowpath is opened through valve assembly 154 between at least one inlet port 167 and at least one outlet port 165 to allow air within poppet line 42 to vent out of vents 172. Venting the air reduces the pressure within poppet line 42, thereby reducing the pressure on one side of shuttle 80 (best seen in FIG. 3B), allowing shuttle 80 to shift positions. Shifting shuttle 80 causes piston 44 to reverse stroke direction.

Valve assembly 154 being removable from valve receiving cylinder 168 provides significant advantages. With valve assembly 154 secured by interfaced threading 173, valve assembly 154 can be removed by twisting valve assembly 154 relative to valve receiving cylinder 168. As such, if valve assembly 154 ices during operation, the user can unscrew valve assembly 154 from valve receiving cylinder 168 and heat valve assembly 154 to remove the ice. For example, the user can grasp valve assembly 154 in the user's hand to heat valve assembly 154 and remove the ice. Furthermore, poppet housing 152 facilitates mounting poppet valve 40 on the exterior of motor cylinder 32. As such, the user does not need to disassembly air motor 30 to access and deice poppet valve 40. Less downtime is required to deice poppet valve 40 and the process of deicing poppet valve 40 is thereby simplified.

Although the present invention has been described with reference to preferred embodiments, workers skilled in the art will recognize that changes may be made in form and detail without departing from the spirit and scope of the invention.

The invention claimed is:

1. An airflow control assembly for an air motor having an air motor cylinder, an exhaust manifold extending at least partially around the air motor cylinder, the exhaust manifold having an exhaust inlet, an exhaust outlet, and an exhaust passage extending between the exhaust inlet and the exhaust outlet, and a control valve configured to provide motive fluid to the air motor cylinder and to receive exhaust fluid from the air motor cylinder, the airflow control assembly comprising:

a first poppet valve configured to mount on the air motor cylinder; the first poppet valve comprising:

a first valve housing including a first base flange, a first valve receiving cylinder extending from a first side of the first base flange, a first line port extending through a side of the first valve receiving cylinder, the first line port configured to receive a first compressed air line to provide compressed air to the first poppet valve, and a vent formed through the first valve housing to vent compressed air from within the first poppet valve; and a first valve assembly disposed at least partially within the first valve receiving cylinder and removably mounted to the first valve housing at a location within the first valve receiving cylinder, the first valve assembly comprising:

a first valve body removably connected to the first valve receiving cylinder, wherein at least one inlet port and at least one outlet port are formed through the first valve body;

a first valve member disposed within the first valve body, the first valve member movable between a closed position fluidly disconnecting the at least one inlet port from the at least one outlet port and an open position fluidly connecting the at least one inlet port and the at least one outlet port; and a first rod extending from the first valve member and out of the first valve housing.

2. The airflow control assembly of claim 1, wherein the first compressed air line is an external poppet line extending from the first line port and configured to interface with the control valve to provide a first flowpath for compressed air between the first poppet vale and the control valve external to the air motor cylinder.

3. The airflow control assembly of claim 1, wherein the vent is at least one vent extends through the receiving cylinder to provide a flowpath to vent air from within the receiving cylinder.

4. The airflow control assembly of claim 3, wherein the at least one vent extends into the receiving cylinder at a location between the first base flange and the line port projection.

5. The airflow control assembly of claim 1, wherein the vent includes a plurality of vents.

6. The airflow control assembly of claim 1, wherein a first spring is disposed between the first rod and the first valve member to bias the first valve member away from the first rod.

7. The airflow control assembly of claim 6, wherein a second spring is disposed within the first valve body on an opposite side of the first valve member from the first rod, the second spring configured to bias the first valve member towards the first rod.

8. The airflow control assembly of claim 1, wherein the first valve body mounts to the first valve receiving cylinder by interfaced threading.

9. The airflow control assembly of claim 1, further comprising:

a second poppet valve configured to mount on the air motor cylinder, the second poppet valve comprising:

a second valve housing including a second base flange, a second valve receiving cylinder extending from a first side of the second base flange, and a second line port extending through a side of the second valve receiving cylinder, the second line port configured to receive a second compressed air line to provide compressed air to the second poppet valve; and a second valve assembly disposed at least partially within the second valve receiving cylinder, the second valve assembly removably mounted to the second valve housing and comprising:

a second valve body projecting out of the second valve receiving cylinder;

a second valve member disposed within the second valve body; and a second rod extending from the second valve member and out of the second valve housing.

10. The airflow control assembly of claim 9, wherein the second compressed air line is an external poppet line extending from the second line port and configured to interface with the control valve to provide a flowpath for the compressed air between the second poppet valve and the control valve that is external to the air motor cylinder.

11. A compressed air powered motor comprising:

the airflow control assembly of claim 9;

the air motor cylinder;

the exhaust manifold extending at least partially around the air motor cylinder;

the control valve configured to provide motive fluid to the air motor cylinder and to receive exhaust fluid from the air motor cylinder; and a connecting rod extending out of a lower side of the air motor cylinder and configured to be reciprocated along an axis;

wherein the first poppet valve is mounted to an upper side of the air motor cylinder opposite the lower side; and wherein the second poppet valve is mounted to the lower side of the air motor cylinder.

12. The compressed air powered motor of claim 11, wherein the first poppet valve and the second poppet valve are radially offset from the axis.

13. An airflow control assembly for an air motor having an air motor cylinder, an exhaust manifold extending at least partially around the air motor cylinder, the exhaust manifold having an exhaust inlet, an exhaust outlet, and an exhaust passage extending between the exhaust inlet and the exhaust outlet, and a control valve configured to provide motive fluid to the air motor cylinder and to receive exhaust fluid from the air motor cylinder, the airflow control assembly comprising:

a first poppet valve configured to mount on the air motor cylinder; the first poppet valve comprising:

a first valve housing including a first base flange, a first valve receiving cylinder extending from a first side of the first base flange, and a first line port extending through a side of the first valve receiving cylinder, the first line port configured to receive a first compressed air line to provide compressed air to the first poppet valve; and a first valve assembly disposed at least partially within the first valve receiving cylinder and removably mounted to the first valve housing at a location within the first valve receiving cylinder, the first valve assembly comprising:

a first valve body removably connected to the first valve receiving cylinder;

a first valve member disposed within the first valve body; and a first rod extending from the first valve member and out of the first valve housing; and a first gasket disposed on a second side of the first base flange opposite the first side of the first base flange.

14. The airflow control assembly of claim 13, further comprising:

a first plurality of fastener openings extending through the first base flange and the first gasket.

15. The airflow control assembly of claim 13, wherein a second gasket is disposed on the first side of the first base flange.

16. The airflow control assembly of claim 15, wherein a first plurality of fastener openings extend through the first gasket, the first base flange, and the second gasket.

17. An airflow control assembly for an air motor having an air motor cylinder, an exhaust manifold extending at least partially around the air motor cylinder, the exhaust manifold having an exhaust inlet, an exhaust outlet, and an exhaust passage extending between the exhaust inlet and the exhaust outlet, and a control valve configured to provide motive fluid to the air motor cylinder and to receive exhaust fluid from the air motor cylinder, the airflow control assembly comprising:

a first poppet valve configured to mount on the air motor cylinder; the first poppet valve comprising:

a first valve housing including a first base flange, a first valve receiving cylinder extending from a first side of the first base flange, and a first line port extending through a side of the first valve receiving cylinder, the first line port configured to receive a first compressed air line to provide compressed air to the first poppet valve; and a first valve assembly disposed at least partially within the first valve receiving cylinder and removably mounted to the first valve housing at a location within the first valve receiving cylinder, the first valve assembly comprising:

a first valve body removably connected to the first valve receiving cylinder;

a first valve member disposed within the first valve body; and a first rod extending from the first valve member and out of the first valve housing; and at least one insulating sheet disposed at least partially around the first valve housing.

18. The airflow control assembly of claim 17, wherein the at least one insulating sheet includes a plurality of insulating sheets.

19. An airflow control assembly for an air motor having an air motor cylinder, an exhaust manifold extending at least partially around the air motor cylinder, the exhaust manifold having an exhaust inlet, an exhaust outlet, and an exhaust passage extending between the exhaust inlet and the exhaust outlet, and a control valve configured to provide motive fluid to the air motor cylinder and to receive exhaust fluid from the air motor cylinder, the airflow control assembly comprising:

a first poppet valve configured to mount on the air motor cylinder; the first poppet valve comprising:

a first valve housing including a first base flange, a first valve receiving cylinder extending from a first side of the first base flange, and a first line port extending through a side of the first valve receiving cylinder, the first line port configured to receive a first compressed air line to provide compressed air to the first poppet valve; and a first valve assembly disposed at least partially within the first valve receiving cylinder and removably mounted to the first valve housing at a location within the first valve receiving cylinder, the first valve assembly comprising:

a first valve body removably connected to the first valve receiving cylinder;

a first valve member disposed within the first valve body; and a first rod extending from the first valve member and out of the first valve housing;

a second poppet valve configured to mount on the air motor cylinder, the second poppet valve comprising:

a second valve housing including a second base flange, a second valve receiving cylinder extending from a first side of the second base flange, and a second line port extending through a side of the second valve receiving cylinder, the second line port configured to receive a second compressed air line to provide compressed air to the second poppet valve; and a second valve assembly disposed at least partially within the second valve receiving cylinder, the second valve assembly removably mounted to the second valve housing and comprising:

a second valve body projecting out of the second valve receiving cylinder;

a second valve member disposed within the second valve body; and a second rod extending from the second valve member and out of the second valve housing;

a first gasket disposed on a second side of the first base flange opposite the first side of the first base flange; and a second gasket is disposed on a second side of the second base flange opposite the first side of the second base flange.

20. The airflow control assembly of claim 19, further comprising:

a third gasket disposed on the first side of the first base flange; and a fourth gasket disposed on the first side of the second base flange.

21. An airflow control assembly for an air motor having an air motor cylinder, an exhaust manifold extending at least partially around the air motor cylinder, the exhaust manifold having an exhaust inlet, an exhaust outlet, and an exhaust passage extending between the exhaust inlet and the exhaust outlet, and a control valve configured to provide motive fluid to the air motor cylinder and to receive exhaust fluid from the air motor cylinder, the airflow control assembly comprising:

a first poppet valve configured to mount on the air motor cylinder; the first poppet valve comprising:

a first valve housing including a first base flange, a first valve receiving cylinder extending from a first side of the first base flange, and a first line port extending through a side of the first valve receiving cylinder, the first line port configured to receive a first compressed air line to provide compressed air to the first poppet valve; and a first valve assembly disposed at least partially within the first valve receiving cylinder and removably mounted to the first valve housing at a location within the first valve receiving cylinder, the first valve assembly comprising:

a first valve body removably connected to the first valve receiving cylinder;

a first valve member disposed within the first valve body; and a first rod extending from the first valve member and out of the first valve housing;

wherein the first valve member and the first rod are retained within the first valve body such that removal of the first valve assembly from the first valve housing removes the first valve body, the first valve member, and the first rod from the first valve housing.

* * * * *